United States Patent [19]

Kawashima et al.

[11] Patent Number: 4,947,723

[45] Date of Patent: Aug. 14, 1990

[54] TONE SIGNAL GENERATION DEVICE HAVING A TONE SAMPLING FUNCTION

[75] Inventors: Susumu Kawashima; Yasuji Uchiyama, both of Hamamatsu, Japan

[73] Assignee: Yamaha Corporation, Hamamatsu, Japan

[21] Appl. No.: 141,422

[22] Filed: Jan. 5, 1988

[30] Foreign Application Priority Data

Jan. 7, 1987 [JP] Japan ..... 62-1209
Jan. 7, 1987 [JP] Japan ..... 62-1210
Jan. 7, 1987 [JP] Japan ..... 62-1211

[51] Int. Cl.[5] ..... G10H 1/057; G10H 1/46; G10H 7/02

[52] U.S. Cl. ..... 84/603; 84/604; 84/627; 84/630; 84/633; 84/DIG. 26; 381/51; 381/63; 360/74.1

[58] Field of Search ..... 84/1.01, 1.27, 1.28, 84/1.13, 1.26, DIG. 29, DIG. 26, 603–607, 627, 630, 633; 360/74.1, 74.4, 90, 105; 381/36, 63, 51

[56] References Cited

U.S. PATENT DOCUMENTS 4,392,405 7/1983 Franz et al. ..... 84/DIG. 26 X
4,396,958 8/1983 Himeno et al. ..... 360/74.1
4,404,606 9/1983 Watanabe ..... 360/105
4,461,199 7/1984 Hiyoshi et al. ..... 84/1.19
4,539,884 9/1985 Aoki ..... 84/1.19 X
4,580,179 4/1986 Sakaguchi et al. ..... 360/74.1 X
4,630,301 12/1986 Hohl et al. ..... 360/74.1 X
4,633,748 1/1987 Takashima et al. .
4,638,389 1/1987 Barth ..... 360/74.1 X
4,667,556 5/1987 Hanzawa et al. .
4,681,008 7/1987 Morikawa et al. ..... 84/1.01 X
4,768,413 9/1988 Fujimori ..... 84/1.28 X

FOREIGN PATENT DOCUMENTS 33199 7/1986 Japan .

*Primary Examiner*—Stanley J. Witkowski
*Attorney, Agent, or Firm*—Spensley Horn Jubas & Lubitz

[57] ABSTRACT

A tone signal applied from outside is sampled by a tone sampling device and the sampled waveshape data is written into a memory. During this writing operation and in parallel with the writing operation, a zero crossing point of the waveshape in terms of the sample data of the tone signal is detected. A final address detection circuit stores, each time a zero cross has been detected, a write address of the waveshape sample data with respect to the memory. Address data which is stored in the final address detection circuit when the writing of the waveshape sample data in the memory has been completed is detected as a final address of the sampled waveshape data. The waveshape data in the memory is read out either in a forward direction in a reverse direction using this final address as a start point or an end point and a tone signal corresponding to the sampled waveshape data is sounded. Such address constituting the start point or end point of reading, i.e., a reference address, can be adjusted by a reference address adjuster. It is also possible, upon completion of the writing into the memory, to read out waveshape data immediately from the memory thereby to immediately and automatically sound the sampled waveshape data which has just been written into the memory.

24 Claims, 9 Drawing Sheets

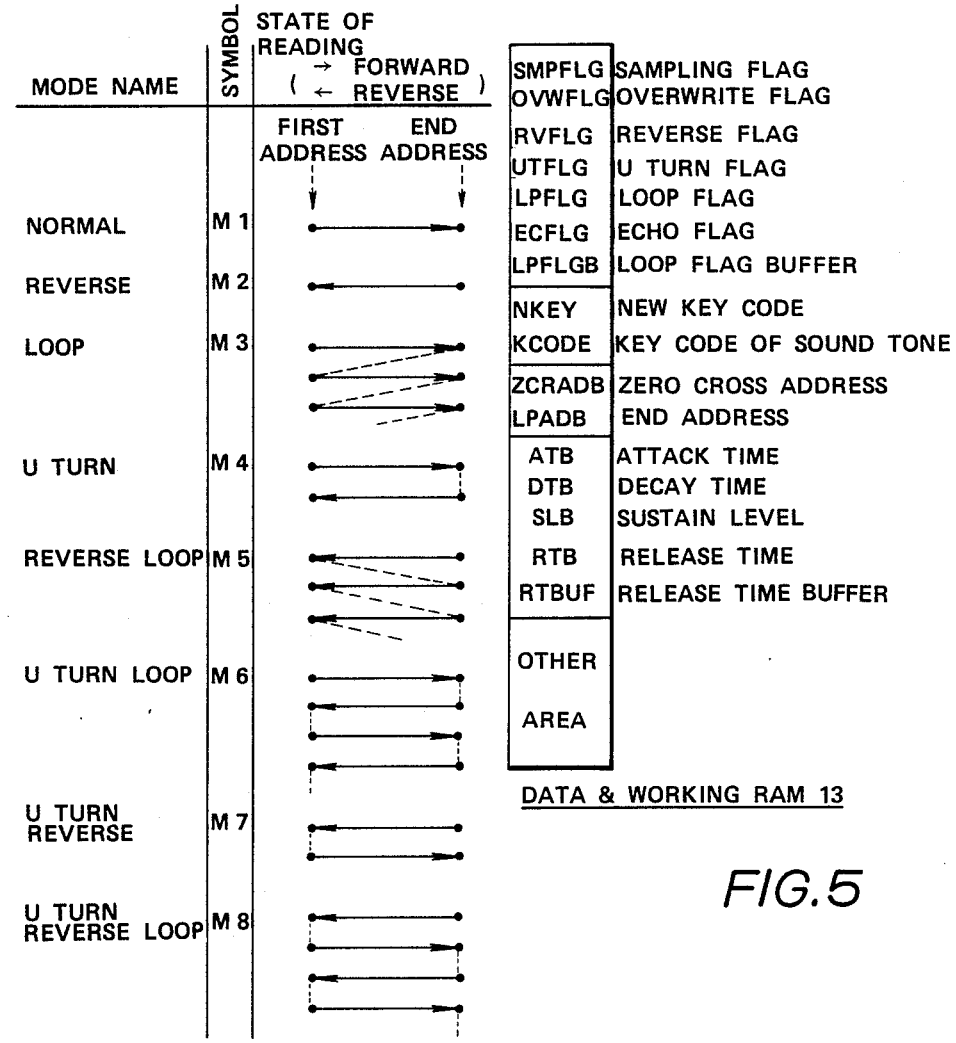
PERFORMANCE MODES TABLE
FIG.3
FIG.5
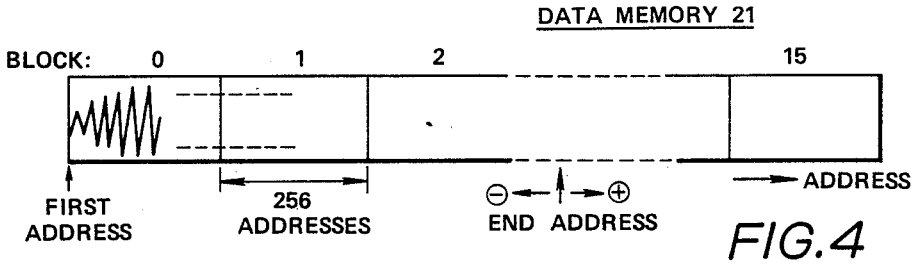
FIG.4

TONE SIGNAL GENERATION DEVICE HAVING A TONE SAMPLING FUNCTION

BACKGROUND OF THE INVENTION

This invention relates to a tone signal generation device capable of sampling a tone signal supplied from outside and storing the sampled tone signal in a memory and thereafter reading out waveshape sample data stored in this memory at a desired tone pitch in response to key operation or the like and, more particularly, to a tone signal generation device capable of instantly detecting a final address of waveshape sample data stored in a memory and thereby coping with reading control using this final address as an end point or a start point of the reading.

Further, this invention relates to a tone signal generation device of a sampling type capable of freely adjusting a reference address as desired by a performer in reading waveshape sample data stored in a memory in a forward or reverse direction using a predetermined reference address as a start point or an end point of the reading.

Further, this invention relates to a tone signal generation device capable of immediately and automatically sounding a tone corresponding to a sampled tone signal.

The tone signal generation device employing a sampling system is disclosed, for example, by Japanese Patent Publication No. 33199/1986. In such prior art tone signal generation device employing the sampling system, there is provided a predetermined memory area for tone signal sample data for one tone and all addresses of this predetermined memory area are accessed in reading. Further, in such prior art tone signal generation device employing the sampling system, tone waveshape sample data once stored in the memory is read out for the first time when some performance operation such as key depression has been made.

U.S. Pat. No. 4,461,199 discloses an art according to which, for preventing occurrence of noise in a head portion in repeated reading of sampled waveshape data of plural periods, a zone crossing point of the waveshape is detected in the head portion of the repeated plural period and this zero cross is utilized as a base address in the repeated reading. For detecting zero cross, sampled waveshape data of plural periods is written in a memory and thereafter is read out and analyzed. In the disclosed art, in repeatedly reading the sampled waveshape data of plural periods, start address and end address are detected in correspondence to head and end portion of the waveshape data and, when the reading has reached the end address, the reading is repeated again after reverting to the start point. In this case, detection of the start address and the end address is performed on the basis of detection of zero cross of the waveshape data.

In the tone signal generation device employing the sampling system, sounding of a tone with variation based on sampled tone is conceived such that waveshape data stored in the memory is not only read out once in the forward direction but also is read out repeatedly many times in the forward direction, or read out once in the reverse direction, or read out repeatedly many times in the reverse direction, or read out once in the forward direction and thereafter read out once in the reverse direction. Since all addresses of the memory area are accessed in the prior art device, there arises the problems that, if a sampled tone is stored in only a part of the memory area, a blank period in repeated reading becomes too long and that sounding of the tone cannot be started immediately in reading in the reverse direction.

For solving such problem, it is desirable to detect actual final address of external tone waveshape sample data stored in the memory and read out this waveshape sample data stored in the memory in the forward or reverse direction, using this final address as an end point or a start point. In this case, it is conceivable to detect zero cross of waveshape data and detect a final address at which zero cross has been detected as the final address.

However, the zero cross detection disclosed in the prior art device in which sampled waveshape data is written in the memory and thereafter is read out and analyzed takes too much time to enable the device to enter a state in which the tone can be instantly sounded. In the prior art device, therefore, it was not possible to read out, for confirming a sampled tone, sampled waveshape data in a selected readout mode immediately after the sampled waveshape data has been written into the memory.

Further, in sounding a tone based on a sampled tone in variation as described above, the prior art device in which all addresses in a predetermined memory area are accessed can repeat sounding only in a limited pattern over all addresses. In the prior art device, a start address and an end address are detected in correspondence to head and last portions of an external tone waveshape sample data stored in the memory and the repeated reading control is performed between these start address and end address but the start address and end address once detected cannot be changed or finely adjusted so that the manner of the repeated reading cannot be changed freely. Further, if noise is contained in waveshape data stored at an address before the end address, this noise cannot be cut off. Further, in the prior art device, it is not possible to create a silent section of a proper time length intentionally in a junction point in the repeated reading thereby to produce a special performance effect in which a tone is intermittently repeated.

Furthermore, in the prior art device, if a performer desires to confirm a sampled tone immediately, he must conduct some performance operation such as key depression which is extremely inconvenient.

SUMMARY OF THE INVENTION

It is therefore an object of the invention to provide a tone signal generation device capable of detecting the actual final address of external tone waveshape sample data written in a memory simultaneously and in parallel with the writing operation and thereby capable of performing reading control in rich variety for reading out the waveshape sample data in the memory in the forward or reverse direction using this final address as an end point or a start point.

It is another object of the invention to provide a tone signal generation device capable of freely adjusting a reference address as desired by the performer in reading out stored waveshape sample data in the forward or reverse direction using a predetermined reference address as a start point or an end point.

It is still another object of the invention to provide a tone signal generation device capable of immediately confirming a tone corresponding to a sampled external tone signal without a special performance operation such as key depression.

For achieving the above described first object of the invention, a tone signal generation device according to the invention comprises tone sampling means for sampling a tone signal applied from outside, memory means capable of both reading and writing for storing waveshape sampled data, write control means for writing waveshape sample data of the tone signal sampled by said tone sampling means into said memory means, zero cross detection means for detecting zero cross of the tone signal or the waveshape sample data, final address detection means for storing write address of waveshape sample data to said memory means each time the zero cross is detected by said zero cross detection means and detecting a final address stored when writing has been completed as a final address of said waveshape sample data, and read control means for reading out said waveshape sample data in said memory means in a forward direction or reverse direction using the final address detected by said final address detection means as an end point or a start point, a tone signal corresponding to said waveshape sample data read out from said memory means being generated.

A tone signal applied from outside is sampled by the tone sampling means and the sampled waveshape sample data of the tone signal is written in the memory means by the control of the write control means. During this writing operation, zero cross of the waveshape sample data supplied from the tone sampling means to the memory means is detected by the zero cross detection means in parallel with the writing operation. The same applies to a case where zero cross is detected from the sampled tone signal itself. The final address detection means stores write address of waveshape sample data to the memory means each time zero cross has been detected by the zero cross detection means and detects a final address stored when the writing of the waveshape sample data has been completed as final address of the waveshape sample data. This final address detected by the final address detection means is utilized by the read control means for reading out the waveshape sample data of the memory means in the forward or reverse direction using this final address as an end point or a start point. A tone signal corresponding to the waveshape sample data read out from the memory means is sounded.

Since, as described above, the actual final address of tone waveshape sample data written in the memory means is detected simultaneously in parallel with the writing operation, readout control in modes of rich variety can be made immediately after writing for reading out the waveshape sample data of the memory means in the forward or reverse direction using this final address as an end point or a start point whereby performance efficiency of the tone signal generation device employing the sampling system can be greatly improved.

For achieving the above described second object of the invention, the tone signal generation device according to the invention comprises tone sampling means for sampling a tone signal applied from outside, memory means capable of both reading and writing for storing waveshape sample data, write control means for writing waveshape sample data of the tone signal sampled by said tone sampling means into said memory means, read control means for reading out said waveshape data in said memory means in a forward direction or reverse direction using a predetermined reference address as a start point or an end point, and reference address adjusting means for increasing or decreasing value of the reference address, a tone signal corresponding to said waveshape sample data read out from said memory means being generated.

A tone signal applied from outside is sampled by the tone sampling means and the sampled waveshape sample data of the tone signal is written in the memory means by the control of the write control means. The read control means reads out the waveshape sample data of the memory means in the forward or reverse direction using a predetermined reference address as a start point or an end point. The value of this reference address can be increased or decreased by the reference address adjusting means. A tone signal corresponding to the waveshape sample data read out from the memory means is sounded.

By changing the value of the reference address by the reference address adjusting means, the start point or end point in reading out the waveshape sample data from the memory means in the forward or reverse direction is changed. By a change in the start point or end point in the reading, the range of addresses to be accessed in the memory means is changed so that the range of a tone sounded is changed.

If, accordingly, an original reference address is set at a final address of waveshape sample data and noise is contained in waveshape sample data stored at an address before this final address, the address at which the noise occurs can be excluded from the range of addresses to be accessed in the memory means by properly adjusting the reference address so as to shift it towards an address before the address at which the noise occurs. Thus, a portion of the waveshape sample data containing the noise can be cut off.

Again, if an original reference address is set at a final address of waveshape sample data, the range of addresses to be accessed in the memory means can be expanded to an address at which waveshape sample data is actually not stored by properly adjusting the reference address so as to shift it towards an address ahead of this final address. By performing repeated reading within this expanded address range, a silent section of a suitable time length can be intentionally created at a junction point in the repeated reading so that a special performance effect in which the tone is intermittently sounded can be produced Besides, the manner of the repeated reading can be freely changed by adjusting the reference address suitably.

By adjusting the reference address which constitutes a start point or an end point in reading out waveshape sample data stored in the memory in the forward or reverse direction freely as desired by the performer, performance efficiency of the tone signal generation device employing the sampling system can be greatly improved.

For achieving the above described third object of the invention, the tone signal generation device according to the invention comprises tone sampling means for sampling a tone signal applied from outside, memory means capable of both reading and writing for storing waveshape sample data, write control means for writing the waveshape sample data of the tone signal sampled by said tone sampling means into said memory means, and read control means for reading out said waveshape sample data written in said memory means in response to completion of writing of said waveshape sample data in said memory means, a tone signal corresponding to said waveshape sample data read out from said memory means being generated.

A tone signal applied from outside is sampled by the tone sampling means and the sampled waveshape sample data of the tone signal is written in the memory by the control of the write control means. In response to completion of writing of the waveshape sample data to this memory means, the waveshape sample data which has just been written into the memory means is read out from the memory means by the read control means. A tone signal corresponding to the waveshape sample data read out from the memory means is generated and sounded. Thus, waveshape sample data sampled from the tone is immediately and automatically read out and sounded in response to completion of writing in the memory means. Accordingly, a tone corresponding to a sampled tone signal can be instantly confirmed without a special performance operation such as key depression whereby performance efficiency of the tone signal generation device employing the sampling system can be improved.

Preferred embodiments of the invention will be described with reference to the accompanying drawings.

BRIEF DESCRIPTION OF THE DRAWINGS

In the accompanying drawings,

FIG. 3 is a diagram schematically showing the manner of reading from the data memory in various performance modes realized in the embodiment of FIG. 2;

FIG. 4 is a diagram showing an example of address structure of the data memory included in a tone generator of FIG. 2;

FIG. 5 is a diagram showing an example of a memory map of a data and working memory in a microcomputer section of FIG. 2;

FIGS. 8 through 19 are flow charts showing an example of a program executed in the microcomputer section of FIG. 2 in which FIG. 8 shows main routine, FIG. 9 sampling event routine, FIG. 10 overwrite event routine, FIG. 11 timer beep end event routine, FIG. 12 key-on event routine, FIG. 13 key-off event routine, FIG. 14 sampling end event routine, FIG. 15 reverse event routine, FIG. 16 echo event routine, FIG. 17 increase event routine, FIG. 18 decrease event routine and FIG. 19 all cancel event routine, respectively.

DESCRIPTION OF PREFERRED EMBODIMENTS

Figure 1A:
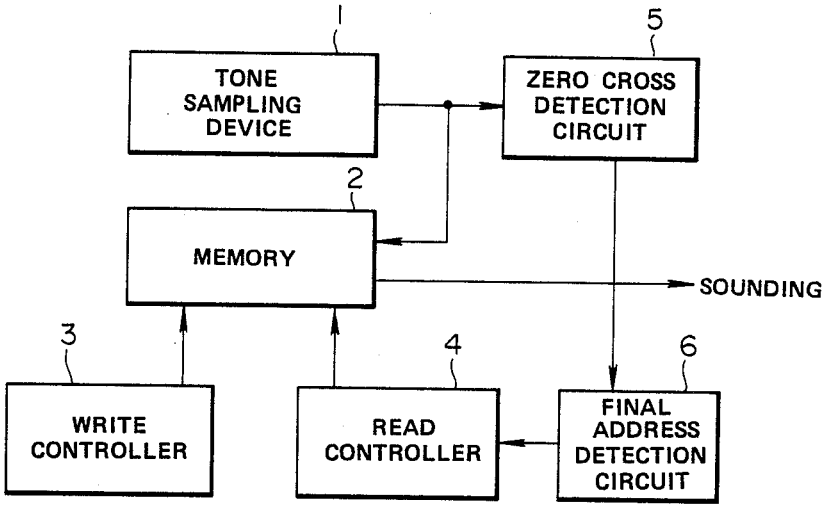
FIGS. 1A, 1B and 1C are functional block diagrams schematically showing an embodiment of the tone signal generation device according to the invention.

In the embodiment of FIG. 1A, a tone signal applied from outside is sampled by a tone sampling device 1 and the sampled waveshape sample data of the tone signal is written in a memory 2 by the control of a write controller 3. During this writing operation, zero cross of the waveshape sample data supplied from the tone sampling device 1 to the memory 2 is detected by a zero cross detection circuit 5 in parallel with the writing operation. The same applies to a case where zero cross is detected from the sampled tone signal itself. A final address detection circuit stores write address of waveshape sample data to the memory 2 each time zero cross has been detected by the zero cross detection circuit 6 and detects a final address stored when the writing of the waveshape sample data has been completed as final address of the waveshape sample data. This final address detected by the final address detection circuit 6 is utilized by a read controller 4 for reading out the waveshape sample data of the memory 2 in the forward or reverse direction using this final address as an end point or a start point. A tone signal corresponding to the waveshape sample data read out from the memory 2 is sounded.

Since, as described above, the actual final address of tone waveshape sample data written in the memory 2 is detected simultaneously in parallel with the writing operation, readout control in modes of rich variety can be made immediately after writing for reading out the waveshape sample data of the memory 2 in the forward or reverse direction using this final address as an end point or a start point whereby performance efficiency of the tone signal generation device employing the sampling system can be greatly improved.

Figure 1B:
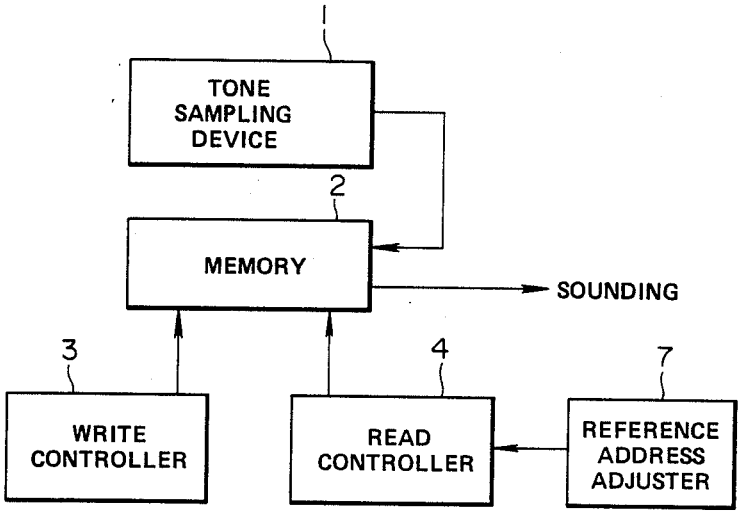

In the embodiment of FIG. 1B, a reference address adjuster 7 is provided in association with a read controller 4. The read controller 4 reads out the waveshape sample data of a memory 2 in the forward or reverse direction using a predetermined reference address as a start point or an end point. The reference address adjuster 7 increases and decreases the value of this reference address.

By changing the value of the reference address by the reference address adjuster 7, the start point or end point in reading out the waveshape sample data from the memory 2 in the forward or reverse direction is changed. By change in the start point or end point in the reading, range of address to be accessed in the memory 2 is changed so that range of a tone sounded is changed.

If, accordingly, an original reference address is set at a final address of waveshape sample data and noise is contained in waveshape sample data stored at an address before this final address, the address at which the noise occurs can be excluded from the range of addresses to be accessed in the memory 2 by properly adjusting the reference address so as to shift it towards an address before the address at which the noise occurs. Thus, a portion of the waveshape sample data containing the noise can be cut off.

Again, if an original reference address is set at a final address of waveshape sample data, the range of addresses to be accessed in the memory 2 can be expanded to an address at which waveshape sample data is actually not stored by properly adjusting the reference address so as to shift it towards an address ahead of this final address. By performing repeated reading within this expanded address range, a silent section of a suitable time length can be intentionally created at a junction point in the repeated reading so that a special performance effect in which the tone is intermittently sounded can be produced. Besides, the manner of the repeated reading can be freely changed by adjusting the reference address suitably.

Figure 1C:
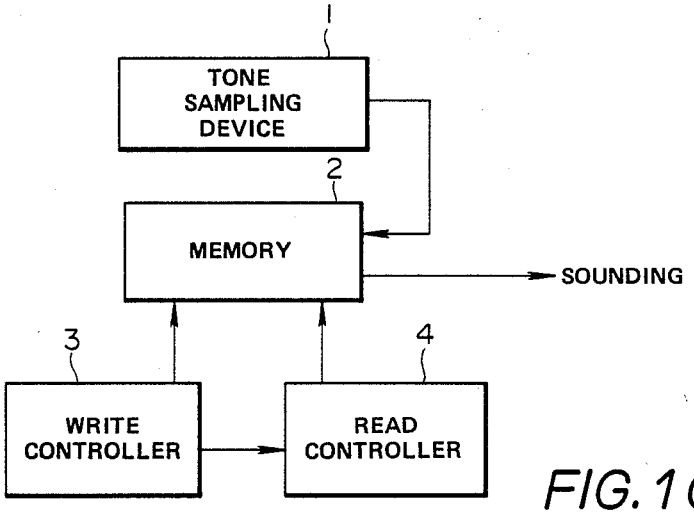

In the embodiment of FIG. 1C, a write controller 3 and a read controller 4 are associated with each other. Upon completion of writing of waveshape sample data in a memory 2, in response to completion of writing of the waveshape sample data, the read control operation of the read controller 4 is started and, by this read control, the waveshape sample data which has just been written into the memory 2 is read out from the memory 2. A tone signal corresponding to the waveshape sample data read out from the memory 2 is generated and sounded. Thus, waveshape sample data sampled from the tone are immediately and automatically read out and sounded in response to completion of writing in the memory 2. Accordingly, a tone corresponding to a sampled tone signal can be instantly confirmed without a special performance operation such as key depression whereby performance efficiency of the tone signal generation device employing the sampling system can be improved.

Figure 2:
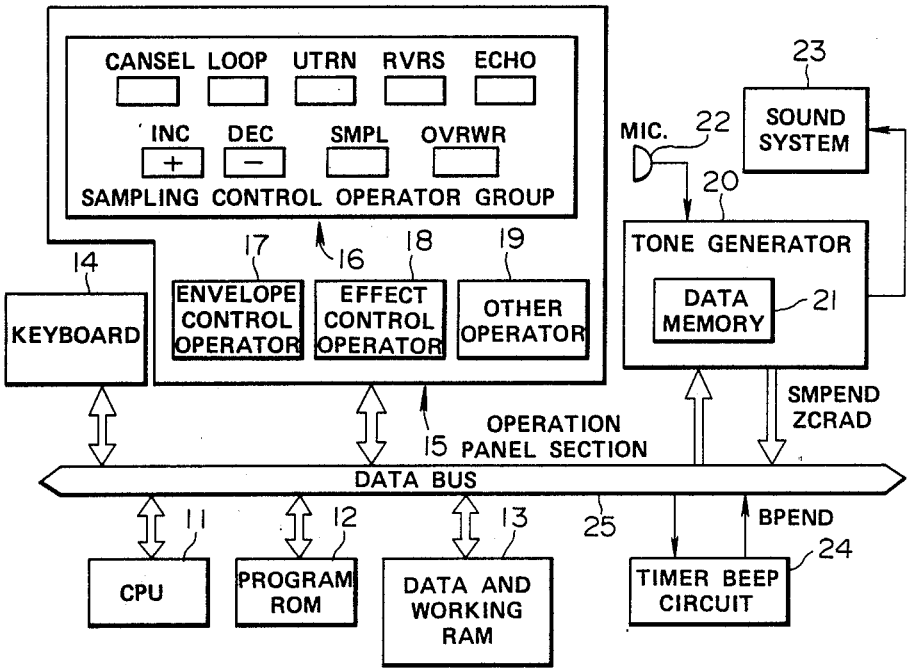
FIG. 2 is a diagram showing a hardware structure showing an embodiment of an electronic musical instrument incorporating the tone signal generation device according to the invention.

FIG. 2 shows a hardware structure of an embodiment in which the tone generation device according to the invention has been applied to an electronic musical instrument. In the electronic musical instrument, various operations and processings are controlled by a microcomputer section comprising a CPU (central processing unit) 11, a program ROM (read-only memory) 12 and data and a working RAM (random-access memory) 13. A keyboard 14 comprises a plurality of keys designating tone pitches of tones to be generated.

An operation panel section 15 comprises a sampling control operator group 16 for controlling sampling of a tone signal applied from outside (hereinafter referred to as an external tone) external sound and reading of the sampled data, an envelope control operator group 17 for setting and controlling an envelope shape of a tone, an effect control operator group 18 for setting and controlling tonal effects and an operator group 19 provided for various tone setting and controlling purposes.

In the sampling control operator group 16, a sampling switch SMPL and overwrite switch OVRWR are switches which designate that a control for writing waveshape sample data of an external tone in a data memory 21 in a tone generator 20 should be made. A reverse switch RVRS, a U turn switch UTRN, a loop switch LOOP and an echo switch ECHO are switches which designate a performance mode in carrying out performance by reading out the waveshape sample data stored in the memory 21.

The sampling switch SMPL is operated for designating that an external tone should be sampled.

The overwrite switch OVRWR is operated for designating also that an external tone should be sampled. This switch however is operated when waveshape sample data of one external tone is overlappingly written (this operation is termed "overwrite") over waveshape sample data of another external tone which has already been stored in the memory 21 without erasing this data. In contrast thereto, when sampling has been designated by the sampling switch SMPL, the previously stored waveshape sample data is erased.

The reverse switch RVRS is operated for designating a performance in which waveshape sample data of an external tone stored in the memory 21 is reversely read out. Such reading is abbreviated hereinafter as "reverse". Reverse reading of the memory 21 means reading data from the memory 21 in the order from data of a larger address value. Forward reading of the memory means reading data from the memory 21 in the order from data of a smaller address value.

The U turn switch UTRN is operated for designating a performance in which waveshape sample data of an external tone stored in the memory 21 is read out in the forward direction and thereafter is read out in the reverse direction. Such reading is abbreviated as "U turn".

It is possible to select and designate "U turn" and "reverse" simultaneously. In this case, waveshape sample data of an external tone stored in the memory 21 is read out in the reverse direction first and thereafter is read out in the forward direction. This is abbreviated as "U turn-reverse".

The loop switch LOOP is operated for designating that waveshape sample data of an external tone stored in the memory 21 should be repeatedly read out. Such reading is abbreviated as "loop". In the normal "loop", waveshape sample data of an external tone stored in the memory 21 is repeatedly read out. This is termed "normal loop".

It is possible to select and designate "loop" and "reverse" simultaneously. In this case, waveshape sample data of an external tone stored in the memory 21 is repeatedly read out in the reverse direction. This is termed "reverse-loop".

It is possible to select and designate "loop" and "U turn" simultaneously. In this case, waveshape sample data of an external tone stored in the memory 21 is repeatedly read out in the forward direction and thereafter read out in the reverse direction and this reading is repeated. This is termed "U turn-loop".

It is also possible to select and designate "loop", "U turn" and "reverse" simultaneously. In this case, waveshape sample data of an external tone stored in the memory 21 is read out in the reverse direction and thereafter read out in the forward direction and this reading is repeated. This is termed "U turn-reverse-loop".

All these performance modes are shown collectively in FIG. 3. There are 8 performance modes which are distinguished from one another by reference characters M1–M8. The left column indicates the mode name which follows the above nomenclature. The condition under which each mode is selected will therefore be apparent from the foregoing description. "Normal" mode M1 is a mode in which waveshape sample data of an external tone stored in the memory 21 is read out only once in the forward direction. When no particular mode among modes M2–M8 is selected, this "normal" mode is selected. The right column indicates schematically states of reading of waveshape sample data from the memory 21 in the respective modes and the direction of the arrow indicates forward direction or reverse direction of reading. In modes M3, M5, M6 and M8 relating to "loop", the reading as illustrated is repeated. The starting point in the forward reading is a predetermined start address and the end point is a predetermined end address. Conversely, the starting point in the reverse reading is an end address and the end point is a start address.

This start address and end address constitute reference addresses designating the starting point or end point in the forward or reverse reading. In this embodiment, one of the reference addresses, i.e., the start address, is always fixed at a predetermined initial address (e.g., addres 0) and the other of the reference address, i.e., the end address, changes in correspondence to the final zero cross address of sampled waveshape data. The value of this reference address, i.e., the end address, can be suitably increased or decreased by the performer. In this embodiment, increase or decrease in the value of the end address can be made only during the modes M3, M5, M6 and M8 associated with "loop".

In the sampling control operator group 16, for designating increase or decrease in the end address, an increase switch INC and a decrease switch DEC are provided. The address value is increased in response to operation of the increase switch INC whereas it is decreased in response to operation of the decrease switch DEC. In this embodiment, the increase or decrease in the end address by the increase switch INC and the decrease switch DEC is conducted, for example, not in one address unit but in a block unit consisting of plural addresses.

An example of address structure in the data memory 21 in the tone generator section 20 will be described with reference to FIG. 4. The entire range of addresses which store waveshape sample data for one tone of an external tone consists of 16 blocks from 0 to 15, one block consisting of 256 addresses. The first address in this entire address range constitutes the start address whose address value is 0. The end address changes in correspondence to the final zero cross of sampled waveshape data. In this embodiment, this end address is determined also in a block unit. The value of this end address increases or decreases in response to operation of the increase switch INC or the decrease switch DEC.

The echo switch ECHO provided in the sampling control operator group 16 selects an echo effect. The echo effect herein means an effect obtained by automatically setting the performance mode to "loop" and automatically setting release time of tone volume envelope of generated tone at a long time (e.g., at the longest time) and thereby repeatedly reading out the sampled waveshape data from the memory 21 to repeatedly sound the tone while the tone volume envelope of a tone signal corresponding to the read out waveshape data is slowly attenuated.

An all cancel switch CANSEL provided in the sampling control operator group 16 is operated to cancel all or selected one of various data set, selected, changed or adjusted in the operation panel section 15 in association with the sampled waveshape sample data and restore contents of such data to an initially sampled state. Alternatively stated, contents of edition of various data edited in association with the sampled waveshape sample data are cancelled and restored to the initial state before editing. By cancelling contents of edition and restoring them to the initial state before editing, editing can be made freely without apprehension of committing mistake whereby the editing function associated with the sampled waveshape sample data can be improved.

The envelope control operator group 17 in the operation panel section 15 consists of operators for setting and control characteristics of tone volume envelope shape to be imparted to the waveshape sample data read out from the data memory 21, e.g., operators for setting and controlling attack time, decay time, sustain level and release time which determine attack, decay, sustain and release characteristics.

The effect control operator group 18 in the operation panel section 15 consists of operators for setting and controlling tonal effects such as vibrato, tremolo and reverberation.

The tone generator section 20 performs a function of sampling a tone signal applied from outside through a microphone 22 and thereby converting it to digital waveshape sample data, a function of writing the sampled digital waveshape sample data into the data memory 21, a function of reading out the waveshape sample data from the data memory 21 in response to key depression in the keyboard 14 or like operation and a function of controlling tone volume envelope of the read out waveshape sample data and imparting various tonal effects thereto. The digital tone signal generated by the tone generator 20 is converted to an analog signal and thereafter is supplied to a sound system 23.

A timer beep circuit 24 is a circuit provided for generating a beeping sound during a certain period of time at the start of sampling of the external tone. Duration of the beeping sound is for example in the order of 300 ms. The beeping sound is started in response to operation of the sampling switch SMPL and a beep end pulse BPEND is generated. In response to the beep end pulse BPEND, the tone generation section 20 starts the sampling operation.

Processings including key scanning processing for detecting depression and release of keys, key assigning processing, scanning processing for detecting operation of switches in the operation panel section 15, processings for lighting and distinguishing displays and writing and reading controls of sampling data in the tone generator section 20 are implemented by the microcomputer section.

An example of flow chart of processings relating to this invention among the processings implemented by the computer section is shown in FIGS. 8–19. An example of contents of storage in the data and working RAM 13 used in connection with these processings is shown in FIG. 5.

SMPFLG denotes a sampling flag which is "1" during the normal sampling mode.

OVWFLG denotes an overwrite sampling flag which is "1" during the overwrite mode.

RVFLG denotes a reverse flag which is "1" during the performance mode of "reverse". This flag is inverted from "1" to "0" or from "0" to "1" each time the reverse switch RVRS is turned on.

UTFLG denotes a U turn flag which is "1" during the performance mode of "U turn". This flag is inverted from "1" to "0" or from "0" to "1" each time the U turn switch UTRN is turned on.

LPFLG denotes a loop flag which is "1" during the performance mode of "loop". This flag is inverted from "1" to "0" or from "0" to "1" each time the loop switch LOOP is turned on.

ECFLG denotes an echo flag which becomes "1" when the echo effect has been selected. This flag is inverted from "1" to "0" or from "0" to "1" each time the echo switch ECHO is turned on.

LPFLGB denotes a loop flag buffer which is provided for preserving, for turning contents of the loop flag LPFLG to "1" compulsorily when the echo effect has been selected, immediately preceding contents of the loop flag. The contents preserved in this buffer LPFLGB are restored to the loop flag LPFLG when the echo effect has ceased to be selected.

NKEY denotes a new key code register which stores a key code of a newly depressed or newly released key.

KCODE denotes a key code register which stores a key code corresponding to a tone which is currently being sounded.

ZCRADB denotes a zero cross address buffer which stores a final zero cross address of waveshape sample data sampled from outside.

LPADB denotes an end address buffer which stores the above described end address.

ATB denotes an attack time buffer, DTB a decay time buffer, SLB a sustain level buffer and RTB a release time buffer respectively which respectively store the attack time, decay time, sustain level and release time which have been set and controlled by the envelope control operator group 17.

RTBUF denotes a release time preservation buffer which is provided for preserving, for compulsorily maintaining contents of the release time buffer RTB for the longest time when the echo effect has been selected, immediately preceding contents of the release time buffer RTB. The contents stored in the buffer RTBUF are restored to the release time buffer RTB when the echo effect has been selected.

The above described registers, flags or areas for buffers are provided in the data and working RAM 13. In the data and working RAM 13 are also provided areas for storing data detected as a result of operations of the effect control operator group 18 and other operator group 19 in the operation panel section 15 and other data and working area.

Figure 6:
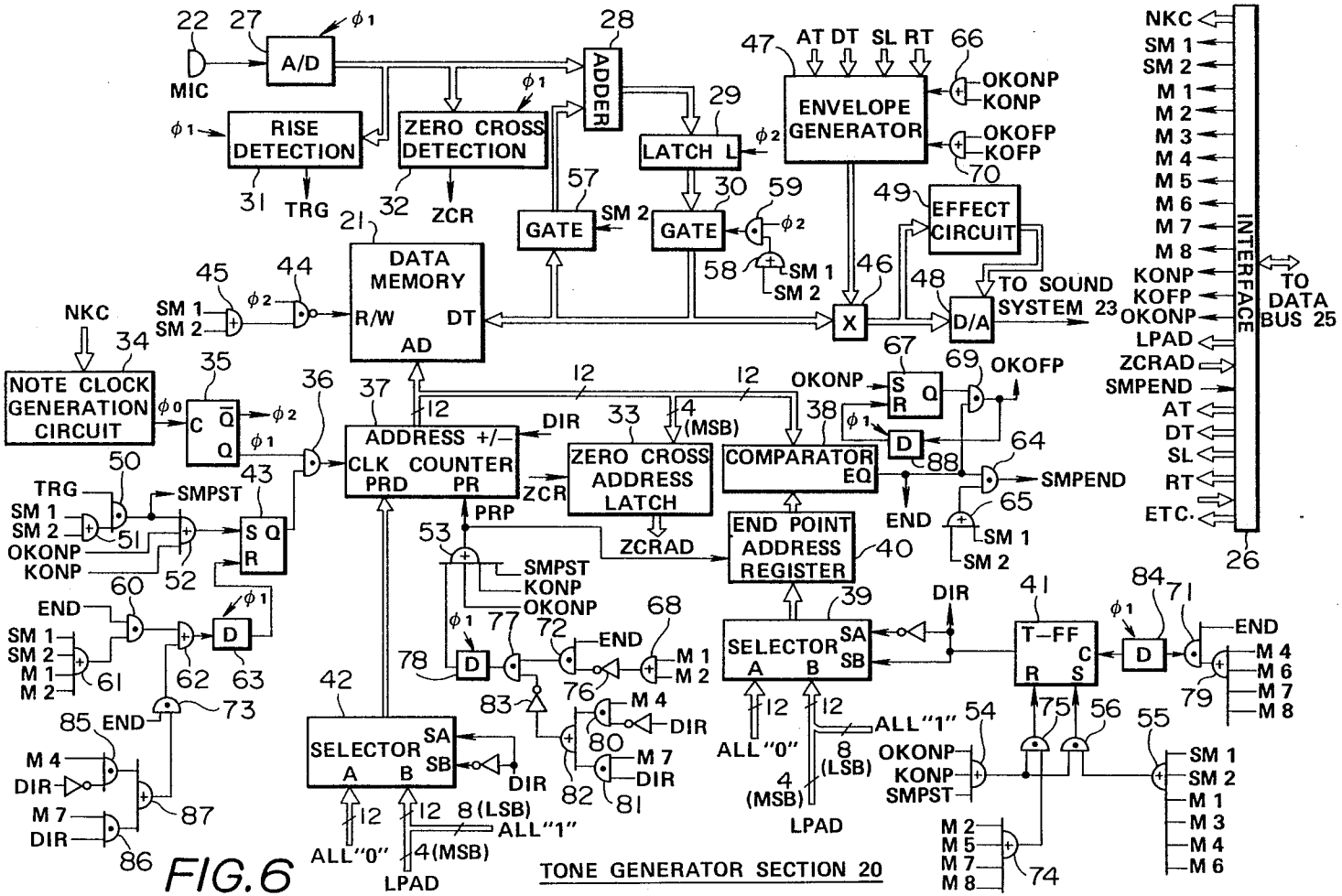
FIG. 6 is a block diagram showing a specific example of the tone generator section of FIG. 2.

A specific example of the tone generator section 20 is shown in FIG. 6.

In the tone generator section 20 in FIG. 6, an interface 26 is provided for transmitting and receiving data with the microcomputer section through a data bus 25. The interface 26 includes a buffer register. Data supplied from the microcomputer section is applied to a predetermined circuit in the tone generator section 20 through the interface 26. Data provided by a predetermined circuit in the tone generator section 20 is supplied to the microcomputer section through the interface 26 and the data bus 25.

Brief description will be made about principal circuits in the tone generator section 20. The data memory 21 consists of an address structure as shown in FIG. 4 described above. When a signal applied to read and write control input R/W is "1", it becomes a read mode whereas when such signal is "0", it becomes a write mode. AD is an address input and DT is a data input and output terminal.

A signal of an external tone picked up by the microphone 22 is sampled in an analog-to-digital converter 27 in response to clock pulse $\phi_1$ and thereby is converted to a digital signal. The waveshape sample data thus converted to a digital signal is applied to the data input and output terminal DT of the data memory 21. The waveshape sample data provided by the analog-to-digital converter 27 is applied to a rise detection circuit 31 in which rising of the tone is detected. A trigger pulse TRG is produced upon rising of the tone. This trigger pulse TRG is used as a signal designating write start timing of the waveshape sample data to be written into the data memory 21.

The waveshape sample data provided by the analog-to-digital converter 27 is supplied also to a zero cross detection circuit 32 where zero crossing is detected. In this embodiment, for simplification of the structure of the zero cross detection circuit 32, whether the level of waveshape sample data has entered a predetermined zero judgement range (range of $\pm\alpha$ of zero level: where $\alpha$ is a selected level) or not is detected and when the level has been deviated from the zero judgement range, a zero cross detection pulse ZCR is produced. The zero cross detection pulse ZCR is applied to a latch control input L of a zero cross address latch circuit 33 whereby write address at the time when zero cross has been detected is latched by the latch circuit 33. The zero cross detection pulse ZCR is generated at each zero cross so that the zero cross address of the latch circuit 33 is rewritten several times and last data left in the latch circuit 33 constitutes the final zero cross address in the waveshape sample data.

Figure 7:
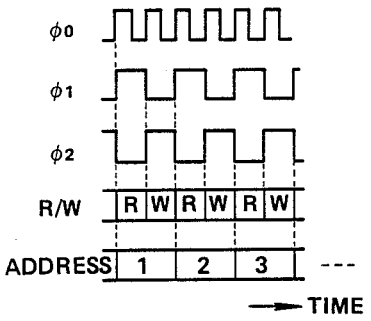
FIG. 7 is a time chart showing an example of note clock pulse in FIG. 6.

A note clock generation circuit 34 generates a note clock pulse $\phi_0$ in response to a new key code NKC. The new key code NKC is used for designating write rate or read rate in the data memory 21. The new key code NKC is set at a key code of a predetermined reference tone pitch (e.g., AE tone) during the sampling and changed in accordance with depression of a key in the keyboard 14. The note clock pulse $\phi_0$ is divided in frequency by two by a frequency divider 35 and note clock pulses $\phi_1$ and $\phi_2$ which are opposite phase to each other as shown in FIG. 7 are thereby produced. The note clock pulse $\phi_1$ of early phase is applied to a count clock input CLK of an address counter 37 through an AND gate 36. The note clock pulse $\phi_2$ of late phase is applied to the read and write input R/W of the data memory 21 to control read and write modes of the memory 21.

As will be described later, when the mode is the sampling mode (i.e., normal sampling mode or overwrite sampling mode), the signal SM1 or SM2 is turned to "1" and a signal "1" is supplied from an OR gate 45 to a NAND gate 44. The NAND gate 44 thereby inverts the late phase note clock pulse $\phi_2$ and supplies this clock pulse to the read and write control input R/W. Accordingly, the data memory 21 becomes the read mode when the early phase note clock pulse $\phi_1$ is "1" and the write mode when the late phase note clock pulse $\phi_2$ is "1" so that the read mode and the write mode are switched within one address time. This arrangement is made for the overwrite sampling mode to be described later. During the various performance modes M1–M8, the signal SM1 and SM2 are "0" and the NAND gate 44 always produces "1" and the data memory 21 is always in the write mode. Since the note clock pulse $\phi_1$ which has been frequency divided by two is counted by an address counter 37, the note clock generation circuit 34 generates the note clock pulse $\phi_0$ which is double the frequency of the object note clock pulse 100 1.

The address counter 37 generates an address signal for designating read and write address of the data memory 21. In the address counter 37, preset data applied to preset data input PRD is preset in response to a preset pulse PRP applied to a preset control input PR and the note clock pulse $\phi_1$ applied to a count clock input CLK is counted starting from this preset value. The address counter 37 is an up/down counter performing upcounting when a direction indicating signal DIR is "1" and downcounting when it is "0".

The output of the address counter 37 is applied to an address input AD of the data memory 21 and also to a comparator 38 and its leftmost 4 bits are applied to the zero cross address latch circuit 33. The address signal consists of 12 bits in which leftmost 4 bits are used for discriminating each block in the blocks of 0–15 and rightmost 8 bits are used for discriminating each of 256 addresses within one block. By latching the leftmost 4 bits of the address signal in the zero cross address latch circuit 33, the zero cross address is detected on the basis of the block unit. The zero cross address data ZCRAD latched by the latch circuit 33 is supplied to the microcomputer section through the interface 26.

The comparator 38 is provided for detecting whether the address signal generated by the address counter 37 has reached the end point or not. When the address signal progresses in the forward direction (i.e., increasing), end address data LPAD is selected by a selector 39 and stored in an end point address register 40. The end address data LPAD is compared with the address signal by the comparator 38 and, when they coincide with each other, an end pulse END is produced (i.e., turned to "1"). When the address signal progresses in the reverse direction (i.e., decreasing), initial address data whose all 12 bits are "0" is selected and stored in the end point address register 40. This initial address data stored in the register 40 is compared with the address signal by the comparator 40 and, when they coincide with each other, the end pulse END is produced.

The selection control of the selector 39 is made in response to a direction indication signal DIR generated from a T-flip-flop 41. When this direction indication signal DIR is "1", i.e., when it indicates change of the address in the forward direction, B input is selected whereas when the direction indication signal DIR is "0", i.e., when it indicates change of the address in the reverse direction, A input is selected.

The end address data LPAD to be described later is supplied from the microcomputer section in response to the above described zero cross address data ZCRAD and consists of 4-bit data indicating the end address on the basis of the block unit. For converting this end address data LPAD of the block unit to data of the address unit, data obtained by adding 8 bits which are all "1" to the LSB of the end address data is applied to the B input of the selector 39. The end address data thereby becomes data representing the final address in the block.

To the preset data input PRD of the address counter 37 is applied the output of a selector 42. In the opposite way to the above described selector 39, this selector 42 selects initial address data whose all 12 bits are "0" applied to the A input when the direction indication signal DIR is "1", i.e., it indicates change of the address in the reverse direction whereas it selects the end address data LPAD applied to the B input when the direction indication signal DIR is "0", i.e., it indicates change of the address in the forward direction. This end address data LPAD also is used as data indicating the final address within the block by adding 8 bits which are all "1" to the LSB thereof.

The end point address data from the selector 39 is loaded in the end point address register 40 in response to the same pulse PRP as the one applied to the preset control input PR of the address counter 37 at the same time as presetting of the address counter 37.

The T-flip-flop 41 generating the direction indication signal DIR is controlled as will be described later in accordance with the sampling mode or various performance modes M1–M8.

A condition of generation of the preset pulse PRP performing the preset control of the address counter 37 is controlled in accordance with the sampling mode or various performance modes M1–M8.

The AND gate 36 which performs control for applying the note clock pulse $\phi_1$ to the count clock input CLK of the address counter 37 is controlled in response to the output signal of a flip-flop 43. States of this flip-flop 43 are controlled as will be described later in accordance with the sampling mode or various performance modes M1–M8.

The waveshape sample data read out from the data memory 21 is applied to a multiplier 46 in which it is multiplied with envelope shape data provided by an envelope generator 47. The envelope generator 47 generates, responsive to key-on pulses KONP and OKONP and key-off pulses KOFP and OKOFP, an envelope shape determined by attack time data AT, decay time data DT, sustain level data SL and release time data RT provided by the microcomputer section through the interface 26. As is well known, an envelope shape portion consisting of attack, decay and sustain portions is generated in response to the key-on pulses and an envelope shape portion consisting of the release portion is generated in response to the key-off pulse. The key-on pulse KONP and the key-off pulse KOFP are produced by the normal key depression operation and the key-on pulse OKONP and the key-off pulse OKOFP are produced for immediately and automatically sounding a tone which has just been sampled.

The waveshape sample data which has been controlled in its tone volume envelope by the multiplier 46 is supplied to a digital-to-analog converter 48 in which it is converted to an analog signal and thereafter is supplied to the sound system 23. The waveshape sample data is supplied also to an effect circuit 49 in which it is imparted with tonal effects such as reverberation, tremolo and vibrato.

Referring now to FIGS. 8 through 19, operations of this electronic musical instrument will be described.

Figure 8:
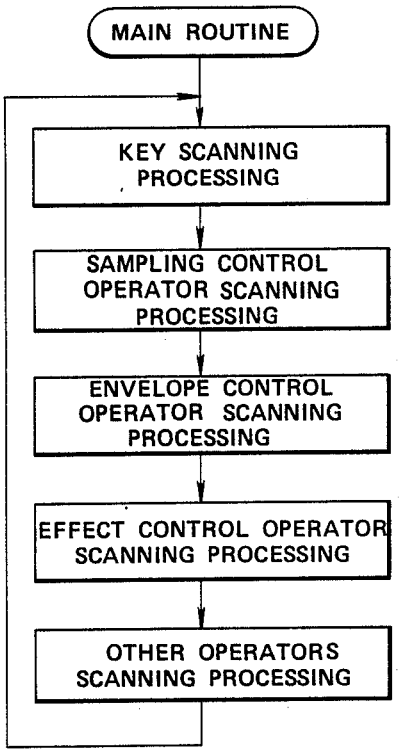
Figure 12:
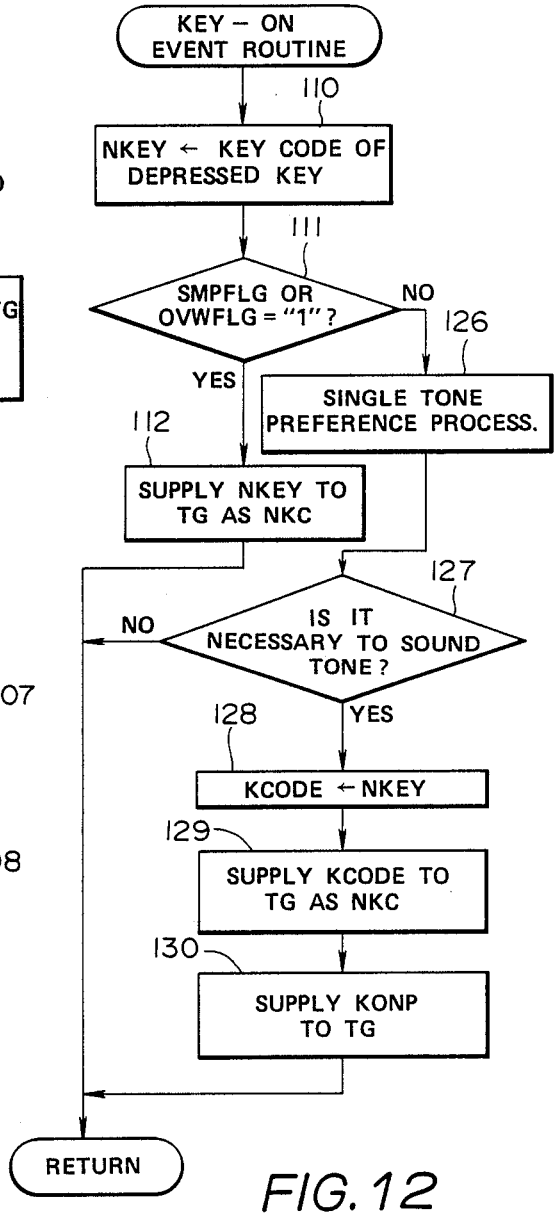
Figure 13:
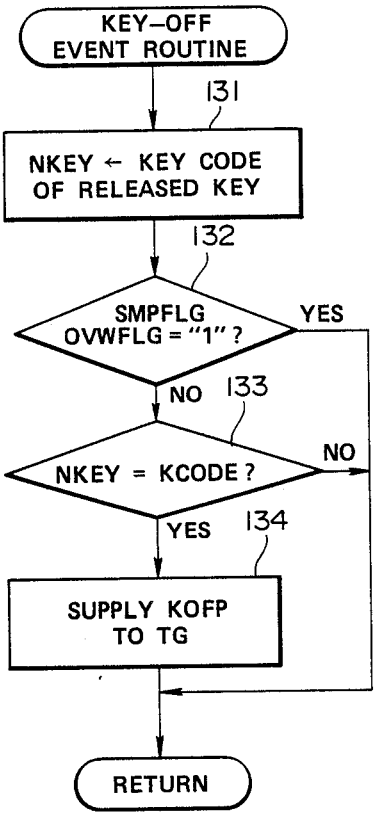

FIG. 8 shows the main routine. In key scanning processing, respective keys in the keyboard 14 are scanned and depressed keys and released keys are detected. Responsive to this detection, certain processings are carried out. In this embodiment, upon detection of a newly depressed key, a key-on event routine as shown in FIG. 12 is executed and upon detection of a newly released key, a key-off event routine as shown in FIG. 13 is executed.

Figure 9:
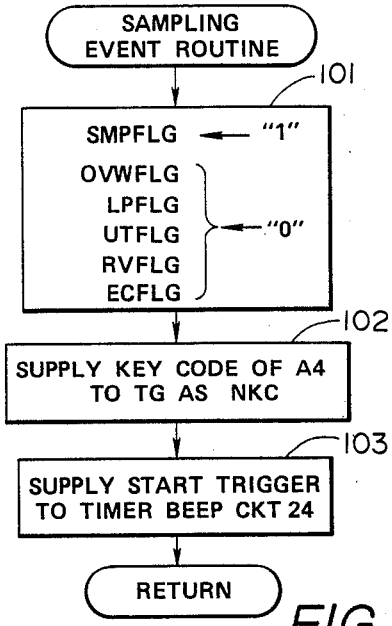
Figure 10:
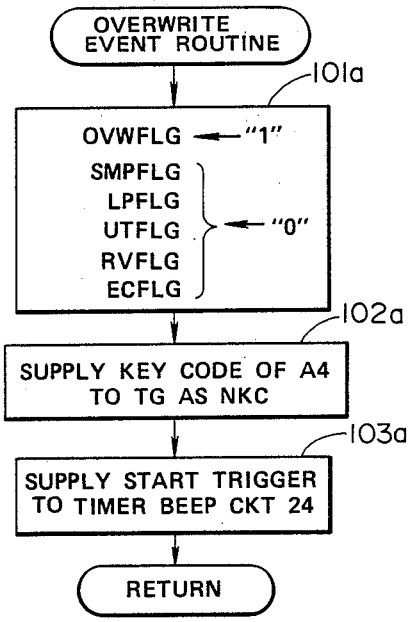
Figure 11:
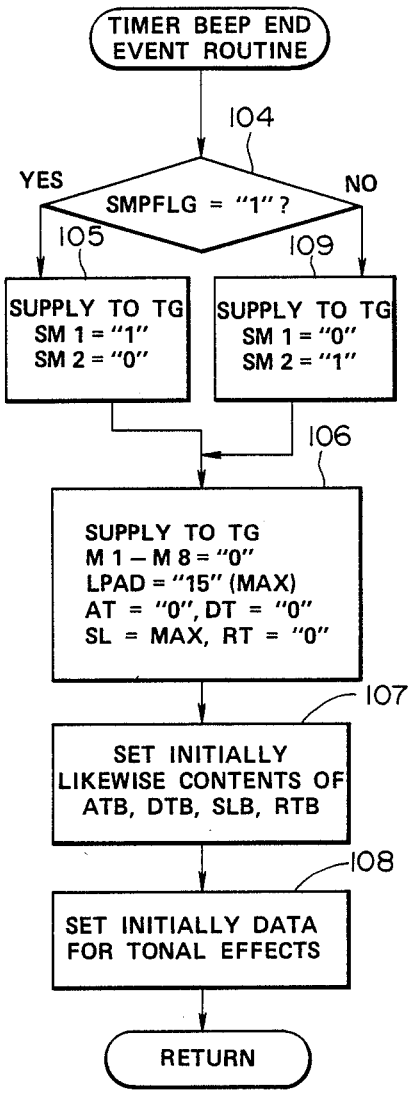
Figure 14:
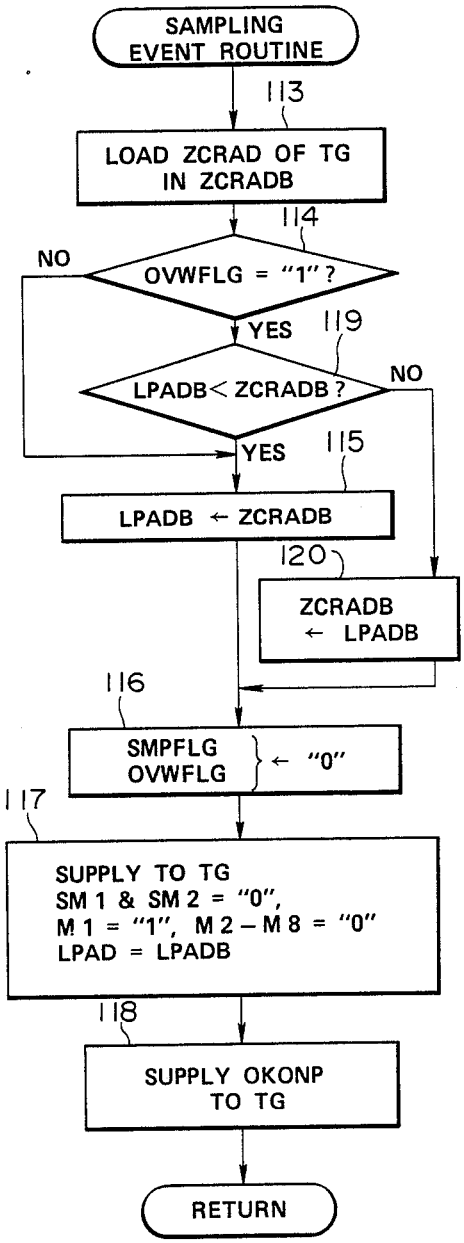

In sampling control operator scanning processing, operations of the respective switches of the sampling control operator group 16 are detected and predetermined processings are executed in accordance with this detection. Upon detection of turning of the sampling switch SMPL from ON to OFF, a sampling event routine shown in FIG. 9 is executed and, upon detection of turning of the overwrite switch OVRWR from OFF to ON, an overwrite event routine shown in FIG. 10 is executed. Upon ceasing of beep tone at the start of sampling, a beep end pulse BPEND provided by the timer circuit 24 is detected and, responsive to this detection, a timer beep end event routine shown in FIG. 11 is executed. Upon ceasing of the sampling of an external tone, a sampling end event routine shown in FIG. 14 is executed in response to a sampling end signal SMPEND provided by the tone generator section 20 as will be described later. Upon detection of turning of the reverse switch RVRS, U turn switch UTRN, loop switch LOOP, echo switch ECHO, increase switch INC, decrease switch DEC and all cancel switch CANSEL from OFF to ON respectively, a reverse event routine, a U turn event routine, a loop event routine, an echo event routine, an increase event routine, a decrease event routine and an all cancel routine shown in FIGS. 5–19 are respectively executed.

In envelope control operator scan processing, operations of the respective operators of the envelope control operator group 17 are detected and, responsive to this detection, certain processings are executed. Data of the attack time, decay time, sustain level and release time set and controlled by the envelope control operator group 17 are stored respectively in the attack time buffer ATB, decay time buffer DTB, sustain level buffer SLB and release time buffer RTB.

In effect control operator scan processing, operations of the respective operators of the effect control operator group 18 are detected and, responsive to this detection, certain processings are executed. In scanning processing of the other operators, operations of the respective operators of the other operator group 19 are detected and, responsive to this detection, certain processings are executed.

Normal sampling operation

For conducting the normal sampling operation, the sampling switch SMPL is first turned on. In response to this, the sampling event routine shown in FIG. 9 is started. In this routine, the sampling flag SMPFLG is set to "1" and the other flags OVWFLG–ECFLG are reset to "0" (step 101). Nextly, a key code of a predetermined reference tone pitch (e.g., A4 tone) is supplied as the new key code NKC to the tone generator section 20 (step 102). A start trigger signal is supplied to the timer beep circut 24 to sound a beep sound (step 103). In the flow chart, the tone generator section 20 is designated by TG.

In the timer beep circuit 24, a beep sound is sounded for a predetermined period of time (e.g., 300 ms) in response to this trigger signal. Upon elapse of this time, the beep end pulse BPEND is produced.

Referring to FIG. 6, in the tone generator section 20, the note clock pulse $\phi_0$ of the reference tone pitch (A4 tone) is generated from the note clock generation circuit 34 in response to the supplied new key code NKC. Before the lapse of the time during which the beep sound is sounded, this note clock pulse comes to be generated in a stable manner and preparation for sampling thereby is completed. In this manner, the beep sound performs a function of noticing completion of preparation for the sampling.

Responsive to the beep end pulse BPEND, the routine of FIG. 11 is started. In step 104, upon confirmation that the sampling flag SMPFLG is "1", the processing proceeds to step 105. In this step, the sampling mode signal SM1 corresponding to the normal sampling mode which is "1" and the sampling mode signal SM2 corresponding to the overwrite sampling mode which is "0" are supplied to the tone generator section 20.

In next step 106, data to be supplied to the tone generator section 20 is initially set in the following manner and then supplied to the tone generator section 20. The mode signals M1–M8 for the respective modes are turned to "0". The end address data LPAD is set to "15" which represents the final block. The attack time data AT, decay time data DT and release time data RT are respectively set to "0" and the sustain level data SL is set to the maximum value "MAX". This is made for establishing an envelope shape of a direct keying type maintaining a constant envelope from the key-on to the key-off. In this direct keying type envelope shape, a tone is sounded in the same tone level as it was sampled.

In next step 107, contents of the attack time buffer ATB, decay time buffer DTB, sustain level buffer SLB and release time buffer RTB in the microcomputer section are likewise initially set to those for eatablishing the direct keying type envelope shape. In next step 108, data for respective tonal effects are also initially set to predetermined contents.

On the other hand, the performer picks up a desired external tone through the microphone 22 after confirming the beep sound. Referring to FIG. 6, as described above, the picked up signal is sampled by the analog-to-digital converter 27 and thereby is converted to a digital signal. Rising of the digitalized waveshape sample data is detected by the rise detection circuit 31 and, responsive to the rise detection, the trigger pulse TRG is produced. This trigger pulse TRG is applied to an AND gate 50. To the other input of the AND gate 50 is applied the sampling mode signal SM1 which is "1" through an OR gate 51 and, in synchronism with the trigger pulse TRG, the output of the AND gate 50 becomes "1" which is supplied through an OR gate 52 to a set input S of the flip-flop circuit 43 as the sampling start pulse SMPST and also is supplied through an OR gate 53 to a preset control input PR of the address counter 37 as the preset pulse PRP and is supplied further to the end point address register 40. To an AND gate 56 are applied the sampling start pulse PST and the sampling mode signal SM1 through an OR gate 54 and an OR gate 55 respectively and an output "1" of the AND gate 56 is supplied to a set input S of the flip-flop 41.

The direction indication signal DIR produced by the T-flip-flop 41 thereby becomes "1" so that the selector 42 selects the initial address (all "0") thereby presetting the address counter 37 and the selector 39 selects the end address LPAD representing the final block and causes this end address to be loaded in the end point address register 40 thereby setting the address counter 37 to upcounting mode. The AND gate 36 is enabled by the set output "1" of the flip-flop 43 whereby the note clock pulse $\phi_1$ of a rate corresponding to the A4 tone is applied to the address counter 37.

Thus, in response to generation of the trigger pulse TRG, the address counter 37 starts upcounting of the note clock pulse $\phi_1$ of the rate corresponding to the A4 tone and the generated address signal changes in the forward direction with the initial address (all "1") constituting the start point and the end address LPAD constituting the end point.

On the other hand, by turning of the sampling mode signal SM1 to "1", as described before, a signal obtained by inverting the note clock pulse $\phi_2$ is applied from the NAND gate 44 to the read and write control input R/W of the data memory 21. The data memory 21 becomes the read mode when the early phase note clock pulse $\phi_1$ is "1" and the write mode when the late phase note clock pulse $\phi_2$ is "1" so that the read and write modes are switched on a time shared basis within one address time. When, however, the sampling mode signal SM1 is "1", the sampling mode signal SM2 is "0" so that a gate 57 provided for applying a read out signal from the data memory 21 to the adder 28 is closed and the key-on pulse for generating envelope shape data from the envelope shape generator 47 is not generated (the multiplier 46 therefore cuts off the read out signal from the data memory 21) and, accordingly, reading has no sense.

The digital waveshape sample data of an external tone provided by the analog-to-digital converter 27 is applied to one input of the adder 28. To the other input of the adder 27 is applied the output of the gate 57 as described above. Since this output of the gate 57 is "0" as described above, the digital waveshape sample data of the external tone is applied to the latch circuit 29 simply passing through the adder 28. The latch circuit 29 performs the latching operation at a timing of the note clock pulse $\phi_2$ which is writing timing. The analog-to-digital conversion operation in the analog-to-digital converter 27 is performed at a timing of the early phase note clock pulse $\phi_1$.

The output of the latch circuit 29 is applied to the data input DT of the data memory 21 passing through the gate 30. The gate 30 is controlled by the output of an OR gate 58 to which the sampling mode signals SM1 and SM2 are applied and the output of an OR gate 59 to which therefore is opened only when the mode is the sampling mode (the normal sampling mode and the overwrite sampling mode) and the note clock pulse $\phi_2$ is "1", i.e., at the writing timing. During the performance modes M1–M8, the signals SM1 and SM2 are both "0" so that the AND gate 59 always produces "0" and the gate 30 is always closed. If, accordingly, noise is picked up by the microphone 22, it can be cut off at this stage.

In the foregoing manner, the digital waveshape sample data of the external tone is applied to the data input DT of the data memory 21 at the writing timing and written into the address designated by the address signal supplied by the address counter 37.

On the other hand, the waveshape sample data produced by the analog-to-digital converter 27 is applied to the zero cross detection circuit 32 in which, as described previously, zero cross is detected in parallel with the writing operation. Responsive to the zero cross detection pulse ZCR provided by the zero cross detection circuit 32, the write address at the time when zero cross is detected is latched by the latch circuit 33. Since the zero cross detection pulse ZCR is generated at each zero cross of the waveshape sample data, the zero cross address of the latch circuit 33 is rewritten several times and the last data left in the latch circuit 33 constitutes the zero cross address. Accordingly, when the sampling has been completed, the final zero cross is already known.

Upon reaching of the write address to the final address in the memory 21, it coincides with the end address LPAD representing the end address of the last block stored in the end point address register 40 so that the comparator 38 produces the end pulse END. This end pulse END is applied to an AND gate 60. This AND gate 60 is enabled by the sampling mode signal SM1 which is "1" from an OR gate 61 and, accordingly, a signal "1" corresponding to the end pulse END is supplied from the AND gate 60 to the reset input R of the flip-flop 43 through an OR gate 62 and a delay flip-flop 63. The delay flip-flop 63 performs delay of one clock of the note clock pulse $\phi_1$. The flip-flop 43 thereby is reset one clock after reaching of the count value to the final address and the AND gate 36 is closed blocking the note clock pulse $\phi_1$. Thus, the counting in the address counter 37 is stopped. Since the preset operation is not performed at this time, the count value is maintaind at the final value. In this manner, writing is made over the entire address range from the initial address to the final address of the data memory 21 during the sampling mode.

The end pulse END is applied to an AND gate 64. This AND gate 64 is enabled by the sampling mode signal SM1 which is "1" supplied from an OR gate 65 and, accordingly, a signal "1" corresponding to the end pulse END is produced by the AND gate 64 and this signal is supplied to the microcomputer section as the sampling end signal SMPEND. The zero cross address data ZCRAD latched by the zero cross address latch circuit 33 is also supplied to the microcomputer section.

Overwrite sampling operation

In a case where waveshape sample data of a newly sampled tone is to be written over the already sampled tone, the overwrite switch OVRWR is turned on. In response to this, the overwrite routine shown in FIG. 10 is executed. In this routine, the overwrite flag OVWFLG is first set to "1" and the other flags are reset to "0" (step 101*a*). Processings of the following steps 102*a* and 103*a* are the same as the stpes 102 and 103 in FIG. 9, i.e., the key code of A4 tone is set as the new key code NKC and the timer beep sound is sounded.

Upon ceasing of the beep sound, timer beep end event routine of FIG. 11 is executed in the same manner as was previously described. In this routine, in step 104, the sampling flag SMPFLG is "0" so that judgement NO is made and the processing proceeds to step 109. In step 109, the sampling mode signal SM1 is set to "0" and the sampling mode signal SM2 is set to "1" and these signals SM1 and SM2 are supplied to the tone generator section 20. Thereafter, processings of steps 106, 107 and 108 are executed in the same manner as in the normal sampling mode.

In the case of the overwrite sampling mode, it is reverse to the normal sampling mode in that the sampling mode signal SM1 is "0" and the sampling mode signal SM2 is "1" and it is the same as the normal sampling mode in other respect.

Referring to FIG. 6, the sampling mode signal SM2 is applied to the OR gates 45, 51, 55, 58, 61 and 65 in the same manner as the sampling mode signal SM1 and the tone generator section 20 operates in entirely the same manner as in the normal sampling mode in these portions. A different point is that the signal SM2 is applied to the control input of the gate 57. The waveshape sample data read out from the data memory 21 thereby is supplied to the adder 28 and added to new waveshape sample data provided by the analog-to-digital converter 27.

As described above, responsive to the signal SM2 which is "1" supplied from the OR gate 45 to the NAND gate 44, a signal obtained by inverting the note clock pulse $\phi_2$ is applied to the read and write control input R/W of the data memory 21 whereby the data memory 21 becomes the read mode in the former half of one address time and the write mode in the latter half thereof. The waveshape sample data of the tone which has precedingly been sampled and read out from the data memory 21 in the former half of one address time is applied to the adder 28 through the gate 57 which has been opened by the signal SM2 which is "1" and added to the waveshape sample data of the external tone which has been newly sampled. The added waveshape sample data is, in the same manner as was previously described, latched by the latch circuit 29 at a timing of the latter half of one address time (timing at which $\phi_2$ is "1") and is applied to the data memory 21 through the gate 30 and written into the designated address of the data memory 21.

Thus, data in which the waveshape sample data of the newly sampled tone is added to the waveshape sample data of the already sampled tone is written in the data memory 21. In the same manner as was previously described, upon reaching of the write address to the final address, the sampling end signal SMPEND is generated from the AND gate 64. Further, in the same manner as was previously described, the last zero cross address of the newly sampled waveshape sample data is latched finally by the latch circuit 33.

Change of the sampling rate

The write rate in the normal sampling mode and the one in the overwrite sampling mode are not limited to the reference tone pitch (A4 tone) but may be changed as desired by depression of the keys in the keyboard 14.

Upon depression of a key of a tone pitch which the performer desires to set as the sampling rate, the new depression of the key is detected by the microcomputer section and the key-on event routine of FIG. 12 is executed. In step 110, the key code relating to the new key depression is stored in the new key code register NKEY. In next step 111, whether the normal sampling flag SMPFLG or the overwrite sampling flag OVWFLG is "1" or not is examined. If it is YES, i.e., the mode is one of the two sampling modes, the processing proceeds to step 112 in which contents of the new key code register NKEY are supplied to the tone generator section 20 as the new key code NKC. The note clock pulse generated by the note clock generation circuit 34 in response to this new key code NKC (i.e., $\phi_1$ and $\phi_2$) corresponds to the tone pitch designated by the keyboard 14.

In the foregoing manner, a desired external tone may be sampled after changing the sampling rate to one corresponding to the desired tone pitch.

Example of using the overwrite sampling rate

Various manners of overwriting are possible according to choice of the performer. By way of example, the following harmonic sampling will be explained.

In the case of C major chord, for example, the sampling rate first is set to the C4 tone and a tone signal of C4 tone with a desired tone color is sampled from outside. Then, the sampling rate is set to E4 tone and a tone signal of C4 tone which is the same as the above tone signal is applied from outside and overwrite sampled. Further, the sampling rate is set to G4 tone and a tone signal of C4 tone which is the same as the above tone signal is applied from outside and overwrite sampled. Thus, data in which waveshape sample data of the tone pitches of 3 tones of C4, E4 and G4 are added together is stored in the data memory 21. In this case, by reading out waveshape sample data from the data memory 21 with a rate of a desired tone pitch corresponding to the key depression, a tone signal of a major chord tone having the tone of the depressed key as the root tone can be sounded.

As will be understood from the foregoing description, the overwrite sampling is convenient in the case, for example, where the chord performance should be made with a simple key depression operation. In a case where, for example, the keyboard 14 is divided into some key ranges and the chord performance should be made in a part of the key ranges, such simple chord performance can be realized by accessing the data memory 21 in accordance with depression of a key in the chord performance key range.

Processing when the sampling has been completed

As described above, upon generation of the sampling end signal SMPEND when the writing of the external tone waveshape sample data has been completed, the sampling event routine shown in FIG. 14 is executed.

In this routine, the zero cross address data ZCRAD latched by the zero cross address latch circuit 33 of the tone generator section 20 is loaded in the zero cross address buffer ZCRADB (step 113). As described previously, this data ZCRAD represents the address at which the final sample data of the sampled tone in the memory 21.

In next step 114,.whether the overwrite sample flag OVWFLG is "1" or not is examined If the result is NO, i.e., the mode is the normal sampling mode, the processing proceeds to step 115 and contents of the zero cross address buffer ZCRADB are stored in the end address buffer LPADB. Thus, the final zero cross address data of the waveshape sample data is stored in the buffer LPADB as the end address data.

Nextly, the sampling flags SMPFLG and OVWFLG are both reset to "0" (step 116) and contents of signals to be supplied to the tone generator section 20 are respectively set so that SM1 and SM2 become "0", M1 becomes "1" and M2–M8 become "0" and contents of the buffer LPADB are supplied as the end address data LPAD (step 117). The key-on pulse OKONP for the immediate sounding is supplied to the tone generator section 20 (step 118). This key-on pulse OKONP is used for sounding the tone corresponding to the sampled waveshape sample data immediately after the sampling to confirm its contents.

Processing when the overwrite sampling has been completed

When the overwrite sampling has been completed, if step 114 of FIG. 14 is judged YES, the processing proceeds to step 119 where whether contents of the current end address buffer LPADB (representing the final zero cross address of the waveshape sample data which was sampled last time)are smaller than contents of the zero cross address buffer ZCRADB (representing the final zero cross address of the currently sampled waveshape sample data) or not is examined. If the result is YES, the processing proceeds to step 115 whereas if the result is NO, the processing proceeds to step 116 through step 120.

In the foregoing manner, in the case of the overwriting, the final zero cross address of data whose address length is the longest of plural external tone sampling data which are overwritten one over another is stored as the end address data in the buffer LPADB.

In step 120, contents of the end address buffer LPADB are set in the zero cross address buffer ZCRADB. This is made for the following reason: Since the final zero cross address (this is stored in the buffer ZCRADB in the preceding step 119) of the currently sampled data among the overwritten external tone sampled data is smaller than the final zero cross address of the precedingly sampled data, it has been found that it cannot be said to represent the final zero cross address if viewed from the entire overwritten data. It is therefore necessary to cause the contents of the buffer LPADB specifying true zero cross address as viewed from the entire waveshape sample data to be stored in the buffer ZCRAD. As will be described later, in the all cancel processing, it is necessary to restore the contents of the zero cross address buffer ZCRADB to the end address buffer LPADB and restore the contents of the buffer LPADB to the true final zero cross address so that the true final zero cross address in the overwritten waveshape must be preserved in the buffer ZCRADB. For this reason, the processing of step 120 is inserted.

Automatic sounding immediately after sampling

Upon completion of writing of the waveshape sample data sampled from outside, as described in the foregoing, the key-on pulse OKONP for the immediate automatic sounding is automatically sounded in step 118 of FIG. 14.

Referring to FIG. 6, in the tone generator section 20, the key-on pulse OKONP for this automatic immediate sounding is supplied to the envelope generator 47 through an OR gate 66 and also supplied to OR gates 52, 53 and 54 and the set input S of a flip-flop 67.

By the processing of step 117 in the above described sampling event routine (FIG. 14), the performance mode signal M1 is "1" and this signal M1 is applied to OR gates 55, 61 and 68 of the tone generator section 20.

The AND condition of the AND gate 56 is satisfied by the key-on pulse OKONP and the signal M1 which is "1" so that the T-flip-flop 41 is set and the direction indication signal DIR becomes "1". Responsive to the key-on pulse OKONP, the preset pulse PRP is provided from the OR gate 53. The initial address data (all "0") is thereby selected by the selector 42 and preset in the address counter 37 and the end address data LPAD is selected by the selector 39 and loaded in the register 40. In the meanwhile, the flip-flop 43 is set in response to the key-on pulse OKONP and the addres counter 37 thereby starts its operation. In this case, since the new key-on signal NKC is not changed, the note clock pulse $\phi_1$ of the same rate as that in the writing time is counted. Thus, the address counter 37 performs upcounting and the address signal changes in the forward direction with the initial address being used as the start point and the end address LPAD as the end point.

The data memory 21 always becomes the read mode because the signals SM1 and SM2 are both "0". The waveshape sample data which has just been written therefore is read out from the head of it.

On the other hand, the envelope generator 47 generates envelope shape data in response to the key-on pulse OKONP. In this case, since the data AT, DT, SL and RT for determining the envelope shape are initially set to contents for determining the direct keying type envelope shape in step 106 in the timer beep end event routine (FIG. 11), envelope shape data with a constant level from the key-on to the key-off is generated. The sampled waveshape sample data thereby is sounded in its direct tone volume level. Thus, the state of the sampled external tone signal can be confirmed instantly. Upon reaching of the read address to a value corresponding to the end address data LPAD, the end pulse END is generated by the comparator 38 and supplied to an AND gate 69. Since the output "1" is supplied to the other input of the AND gate 69 from the flip-flop 67 which has been set by the key-on pulse OKONP, the output of the AND gate 69 becomes "1" in response to the end pulse END and this signal is supplied to the envelope generator 47 through an OR gate 70 as key-off pulse OKOFP for the immediate and automatic sounding. In response to this automatically prepared key-off pulse OKOFP, the direct keying type envelope shape data generated by the envelope generator 47 falls to the level 0. The immediate and automatic sounding thereby is ceased. The flip-flop 67 is reset by a signal obtained by delaying the key-off pulse OKOFP by a delay flip-flop 88.

Determination of the performance mode

The above described 8 types of performance modes M1–M8 (see FIG. 3) are determined by operations of the switches RVRS, UTRN and LOOP.

Figure 15:
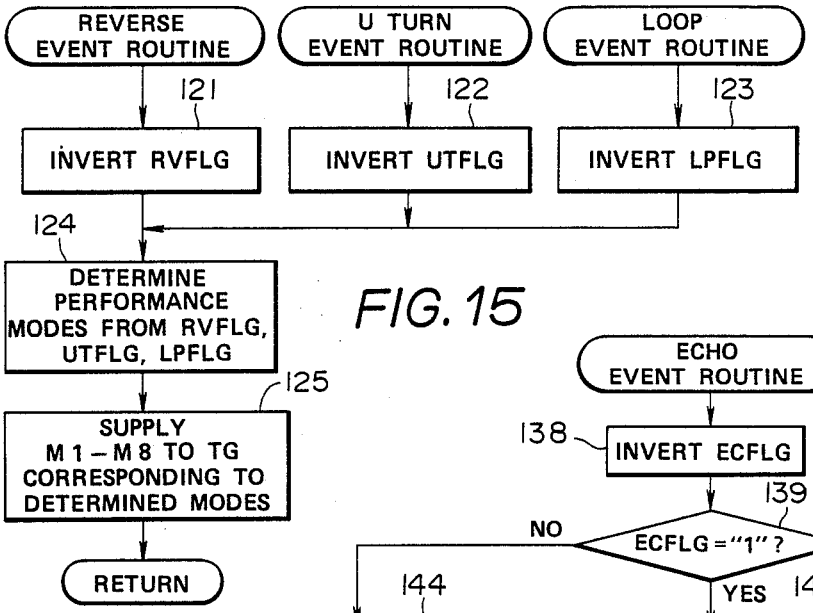

Upon turning on of the reverse switch RVRS, reverse on event routine of FIG. 15 is executed and the reverse flag RVFLG is inverted from "0" to "1" or from "1" to "0" (step 121). The processing then proceeds to step 124.

Upon turning on of the U turn switch UTRN, U turn event routine of FIG. 15 is executed and the U turn flag UTFLG is inverted from "0" to "1" or from "1" to "0" (step 122). The processing then proceeds to step 124.

Upon turning on of the loop switch LOOP, loop event routine of FIG. 15 is executed and the loop flag LPFLG is inverted from "0" to "1" or from "1" to "0" (step 123). The processing then proceeds to step 124.

In step 124, the performance modes M1–M8 are determined in accordance with the following Table 1 in response to the respective flags RVFLG, UTFLG and LPFLG.

TABLE 1

| Flag | | | |
|---|---|---|---|
| RVFLG | UTFLG | LPFLG | Mode |
| 0 | 0 | 0 | M1 |
| 1 | 0 | 0 | M2 |
| 0 | 0 | 1 | M3 |
| 0 | 1 | 0 | M4 |
| 1 | 0 | 1 | M5 |
| 0 | 1 | 1 | M6 |
| 1 | 1 | 0 | M7 |
| 1 | 1 | 1 | M8 |

Nextly, in step 125, the mode signals M1–M8 of contents corresponding to the performance modes thus determined are supplied to the tone generator section 20. In other words, one mode signal only determined according to Table 1 is "1" and the other mode signals are "0".

Key-on and key-off processings during the performance mode

When waveshape sample data stored in the data memory 21 is read out and sounded, a desired key is depressed in the keyboard 14.

When a key has been depressed, the key-on event routine of FIG. 12 is executed and the key code of the depressed key is loaded in the new key code register NKEY (step 110). In next step 111, result of judgement is NO since the sampling flags SMPFLG and OVWFLG are both "0" and the processing proceeds to step 126. In step 126, a predetermined key assignment processing (in the present embodiment, a single tone preference processing because the single tone preference system is adopted) is executed. In next step 127, whether it is necessary to sound a tone of a newly depressed key or not is judged. If such sounding of a new tone is not necessary, the processing proceeds to step 128. As reference of the single tone preference, the known high frequency tone preference or late-coming preference may be employed as required. In step 128, the new key code of the register NKEY is stored in the register KCODE. In next step 129, the key code of the register KCODE (i.e., the key code of the newly depressed key which has been newly key-assigned) is supplied to the tone generator section 20 as the new key code NKC. In further step 130, the key-on pulse KONP is supplied to the tone generator section 20.

When a depressed key has been released, the key-off event routine of FIG. 13 is executed. The key code of the newly released key is loaded in the new key code register NKEY (step 131), whether the sampling flags SMPFLG and OVWFLG are "1" or not is examined (step 132) and the processing proceeds to step 133 on condition that the result is NO, i.e., it is in the performance mode. In step 133, whether the released key is being currently sounded (NKEY =KCODE) or not is examined. If so, the key-off pulse KOFP is supplied to the tone generator section 20.

Performance operation

The operations of the tone generator section 20 in the respective performance modes M1–M8 will now be described.

[Explanation common to all modes]

In response to depression of a key, the key code of the depressed key is supplied as the new key code KNC as described above and, responsive to this new key code NKC, the note clock pulse $\phi_0$ of the depressed key is produced by the note clock generation circuit 34. The flip-flop 43 is set by the key-on pulse KONP through the OR gate 52 and the note clock pulse $\phi_0$ is applied to the count input CLK of the address counter 37 whereby counting of the address signal is started.

Contents of the direction indication signal generated by the T-flip-flop 41 are different, as will be described later, depending upon states of the signals M1–M8 corresponding to the respective performance modes. In response to the contents of the signal DIR, the counting direction of the address counter 37 is determined and the address signal changes in response to the note clock pulse $\phi_1$ and waveshape sample data is read out from the data memory 21.

The key-on pulse KONP and the key-off pulse KOFP generated upon depression and release of the key as described above are supplied to the envelope generator 47 through OR gates 66 and 70. In response to these pulses, envelope shape data is generated and a tone volume envelope of waveshape sample data read out from the data memory 21 is controlled by this envelope shape data and sounded. The respective envelope shape determining data AT, DT, SL and RT have contents determined by the envelope operator group 17 so that the tone volume envelope of the waveshape sample data is controlled by an envelope shape of a desired shape determined by the envelope operator group 17.

The processing at the time when the end pulse END is generated by the comparator 38 differs depending upon the signals M1–M8 corresponding to the respective performance modes, as will be described more fully later.

[Mode M1: Normal performance]

When the mode signal M1 is "1", the AND condition of the AND gate 56 is satisfied by the key-on pulse KONP and the signal M1 which are both "1" supplied through the OR gates 54 and 55 and the T-flip-flop 41 is thereby set and the direction indication signal DIR becomes "1". In response to the key-on pulse KONP, the OR gate 53 generates the preset pulse PRP. By this arrangement, in the same manner as in the previously described immediate and automatic sounding, waveshape sample data is read out from the data memory 21 only once in the forward direction.

Upon reaching of the read address to the end address LPAD, the end pulse END is generated. This end pulse END is applied to AND gates 60, 71 and 73. To the other input of the AND gate 60 is applied the signal M1 which is "1" through the OR gate 61 so that a signal "1" is applied to the reset input R of the flip-flop 43 through the AND gate 60, OR gate 62 and flip-flop 63 in response to the end pulse END. Thus, when the read address has reached the end address LPAD, counting of the address counter 37 is stopped. The other AND gates 71, 72 and 73 are not operated when the signal M1 is "1".

In this manner, in the case of the performance mode M1, i.e., normal memory readout mode, sounding of the tone is made by accessing the data memory 21 only once in the forward direction.

[Mode M2: Reverse]

When the mode signal M2 is "1", the AND condition of an AND gate 75 is satisfied by the key-on pulse KONP supplied through OR gates 54 and 74 and the signal M2 which is "1" so that a signal "1" is applied to the reset input R of the T-flip-flop 41. The T-flip-flop 41 thereby is reset and the direction indication signal DIR becomes "0". Responsive to this direction indication signal DIR which is "0", the selector 42 selects the end address data LPAD and the selector 39 selects the initial address data (all "0"). In response to the key-on pulse KONP, the preset pulse PRP is generated from the OR gate 53. Accordingly, conversely to the case of the above described mode M1, waveshape sample data is read out from the data memory only once in the reverse direction with the end address LPAD constituting the start address and the initial address constituting the end point.

Upon reaching of the read address to the initial address, the comparator 38 generates the end pulse END. This end pulse END is applied to AND gates 60, 71, 72 and 73. To the other input of the AND gate 60 is applied the signal M2 which is "1" through the OR gate 61 so that a signal "1" is applied to the reset input R of the flip-flop 43 through the AND gate 60, OR gate 62 and the delay flip-flop 63 in response to the end pulse END. Counting in the address counter 37 is thereby stopped when the read address has reached the initial address. The other AND gates 71, 72 and 73 are not operated when the signal M2 is "1".

In the foregoing manner, in the case of the performance mode M2, i.e., "reverse" mode, sounding of the tone is made by accessing the data memory 21 only once in the reverse direction.

[Mode M3: Loop]

When the mode signal M3 is "1", the AND condition of the AND gate 56 is satisfied by the key-on pulse KONP supplied through the OR gate 54 and 55 and the signal M3 which is "1" so that the T-flip-flop 41 is set and the direction indication signal DIR becomes "1". The preset pulse PRP is generated in response to the key-on pulse KONP. In the same manner as in the mode M1, waveshape sample data is read out from the data memory 21 in the forward direction with the initial address constituting the start point and the end address LPAD constituting the end point.

When the read address has reached the end address LPAD, the comparator 38 generates the end pulse END. This end pulse END is applied to the AND gate 60. Since the mode signals M3–M8 are not applied to the OR gate 61, the flip-flop 43 is not reset by the end pulse END so that counting of the address counter 37 is not stopped.

On the other hand, the output of the OR gate 68 becomes "0" and the output of the inverter 76 which inverts this output becomes "1" in response to the signals M1 and M2 which are "0" and, accordingly, the output of the AND gate 71 becomes "1" in response to the end pulse END. The output "1" of the AND gate 72 is applied to an AND gate 77. Since the output signal of an inverter 83 which is applied to the other input of the AND gate 77 is always "1" when the signals M4 and M7 are "0", the AND condition of the AND gate 77 is satisfied in response to the end pulse END and the preset pulse PRP is generated through delay flip-flop 78 and OR gate 53 in response to the output signal "1" of the AND gate 77.

The end pulse END is applied also to the AND gate 71. Since, however, the output of the OR gate 79 is "0", the AND condition of the AND gate 71 is not satisfied so that the state of the T-flip-flop remains unchanged. The direction indication signal DIR therefore is maintained in the state of "1" so that, responsive to the preset pulse generated when the read address has reached the end address LPAD, the initial address data (all "0") is preset in the address counter and the end address data LPAD is loaded in the register 40. Further, the address counter 37 remains in the upcount mode. Thus, waveshape sample data is read out again in the forward direction with the initial address constituting the start point and the end address LPAD constituting the end point.

In the case of "loop", therefore, waveshape sample data of the data memory 21 is repeat read out in the forward direction and a tone based on the sampled external tone is repeatedly sounded. By releasing the depressed key and thereby attenuating the tone volume control envelope, the sounding of the tone is finished.

[Mode 4: U turn]

When the mode signal M4 is "1", the AND condition of the AND gate 56 is satisfied by the key-on pulse KONP supplied through the OR gates 54 and 55 and the signal M4 which is "1" so that the T-flip-flop 41 is set and the direction indication signal DIR becomes "1". In response to the key-on pulse KONP, the preset pulse PRP is generated from the OR gate 53. Therefore, in the same manner as in the mode M1, waveshape sample data is read out from the data memory 21 in the forward direction with the initial address constituting the start point and the end address LPAD constituting the end point.

When the read address has reached the end address LPAD, the comparator 38 produces the end pulse END. This end pulse END is applied to the AND gate 60. Since, however, the mode signals M3–M8 are not supplied to the OR gate 61, the output of the AND gate 60 remains "0". The end pulse END is applied also to the AND gate 73 but the output of the AND gate 73 is also "0". More specifically, if the direction indication signal DIR is "1" when the signal M4 is "1" (i.e., the address is changing in the forward direction), the output of an AND gate 85 which has received this signal M4 and an inverted signal of the direction indication signal DIR is "0" and the output of an AND gate 86 which has received the signal M7 and the signal DIR is also "0" so that a signal applied from an OR gate 87 to the AND gate 73 is "0" and the AND condition of the AND gate 73 is not satisfied. Accordingly, the output of the OR gate 62 which has received the outputs of the AND gates 60 and 70 are "0" and the flip-flop 43 is not reset by the end pulse END which is generated during the counting operation in the forward direction with a result that the address counter 37 does not cease its counting.

On the other hand, the output of the OR gate becomes "0" due to the signals M1 and M2 which are both "0", and the output of the inverter 76 becomes "1" and, responsive to the end pulse END, the output of the AND gate 72 becomes "1". The output "1" of the AND gate 72 is applied to an AND gate 77. If the direction control signal DIR is "1" when the signal M4 is "1" (i.e., the address is changing in the forward direction), the ouptut of an AND gate 80 receiving the signal M4 and an inverted signal of the signal DIR is "0" and the output of an AND gate 81 receiving the signal M7 and the signal DIR is also "0". The output of an OR gate 82 which receives the outputs of the two AND gates 80 and 81 therefore is "0" and the output of an inverter 83 which inverts this signal is "1" and the output of the AND gate 77 which receives this signal "1" is "1". In response to this output signal "1" of the AND gate 77, the preset pulse PRP is generated though a delay flip-flop 78 and the OR gate 53.

The end pulse END is applied to the AND gate 71 and, since the output of the OR gate 79 is "1" due to the signal M4 which is "1", the AND condition of the AND gate 71 is satisfied and a signal "1" is applied to the count input C of the T-flip-flop 41 through a delay flip-flop 84 to invert the state of the T-flip-flop 41 from "1" to "0". The selector 42 therefore selects the end address data LPAD and the selector 39 selects the initial address data (all "0") and these address data are preset in the counter 37 and loaded in the register 40 in response to the preset pulse PRP generated in the above described manner. Thus, conversely to the preceding reading, waveshape sample data is read out from the data memory 21 in the reverse direction with the end address LPAD constituting the start point and the initial address constituting the end point.

When the read address has reached the initial address, the comparator 38 generates the end pulse END. The direction indication signal this time is "0" and its inverted signal is "1" so that the AND conditions of AND gates 80 and 85 are satisfied. The output of the AND gate 73 therefore becomes "1" and the flip-flop 43 thereby is reset. Accordingly, the address counter 37 stops counting when the read address has reached the initial address (all "0"). The output of the AND gate 77 becomes "1" due to the output "1" of the AND gate 80 so that the preset pulse PRP ceases to be generated.

In the foregoing manner, in the case of "U turn", waveshape sample data in the data memory 21 is read once in the forward direction and then waveshape sample data in the data memory 21 is read once in the reverse direction.

[Mode 5: Reverse-Loop]

When the mode signal M5 is "1", the AND condition of the AND gate 75 is satisfied due to the key-on pulse KONP supplied through the OR gates 54 and 74 and the signal M5 which is "1" so that a signal "1" is supplied to the reset input of the T-flip-flop 41. The T-flip-flop 41 thereby is reset and the direction indication signal DIR becomes "0". In response to this direction indication signal which is "0", in the same manner as in the above described mode M2, waveshape sample data is read out from the data memory 21 in the reverse direction with the end address LPAD constituting the start point and the initial address constituting the end point.

When the read address has reached the initial address, the comparator 38 generates the end pulse END. As in the mode M3 (loop), the flip-flop 43 is not reset by the end pulse END so that the address counter 37 does not cease its counting. Further, responsive to the end pulse END, the AND condition of the AND gate 77 is satisfied and the preset pulse PRP is generated. The AND condition of the AND gate 71 is not satisfied though the end pulse END is generated so that the state of the T-flip-flop 41 is not changed. The direction indication signal DIR therefore remains unchanged staying at "0" and, when the read address has reached the initial address, the end address data LPAD is preset in the address counter 37 and loaded in the register 40 in response to the preset pulse PRP generated in the foregoing manner. The address counter 37 remains in the downcount mode. Thus, waveshape sample data is read out from the data memory 21 again in the reverse direction with the end address LPAD constituting the start point and the initial address constituting the end point.

Thus, in the case of "reverse loop", waveshape sample data is repeatedly read out from the data memory 21 in the reverse direction so that a tone in which a sampled external tone is rearranged in the timewise reverse direction is repeatedly sounded. By attenuating the tone volume control envelope by release of the depressed key, this sounding can be finished.

[Mode M6: U turn-Loop]

When the mode signal M6 is "1", the AND condition of the AND gate 56 is satisfied by the key-on pulse KONP supplied through the OR gates 54 and 55 and the signal M6 which is "1" so that the T-flip-flop 41 is set and the direction indication signal DIR becomes "1". In response to the key-on pulse KONP, the preset pulse PRP is generated from the OR gate 53. Responsive to this, as in the mode M1, waveshape sample data is read out from the data memory 21 in the forward direction with the initial address constituting the start point and the end address LPAD constituting the end point.

When the read address has reached the end address LPAD, the comparator 38 generates the end pulse END. When the signal M6 is "1", the AND condition of the AND gate 73 is not satisfied so that the flip-flop 43 is not reset by the end pulse END and the address counter 73 does not cease its counting. The AND condition of the AND gate 77 is satisfied by the end pulse END and the preset pulse PRP is generated. Since the output of the OR gate 79 is "1" due to the signal M6 which is "1", the AND condition of the AND gate 71 is satisfied by the end pulse END and a signal "1" is applied to the count input C of the T-flip-flop 41 through a delay flip-flop 84 so that the state of the T-flip-flop 41 is inverted from "1" to "0". The direction indication signal DIR therefore becomes "0". The counting direction of the address counter 37 thereby becomes reverse to the preceding reading so that waveshape sample data is read out form the data memory 21 in the reverse direction with the end address LPAD constituting the start point and the initial address constituting the end point.

When the read address has reached the initial address, the end pulse END is generated and, in the same manner as in the case described above, the AND condition of the AND gates 71 and 77 is satisfied and the preset pulse PRP is generated. The state of the T-flip-flop 41 is inverted from "0" to "1" and the direction indication signal DIR becomes "1". The counting direction of the address counter 37 is thereby restored to the forward direction and waveshape sample data is read out from the data memory 21 in the forward direction with the initial address constituting the start point and the end address LPAD constituting the end point. Then, upon generation of the end pulse END, the counting direction of the address counter 37 is inverted.

Subsequently, the U turn reading is repeated each time the end pulse END is generated.

Thus, in the case of "U turn loop", waveshape sample data of the data memory 21 is read out in the forward direction and thereafter is read out in the reverse direction and this U turn reading is repeated.

[Mode M7: U turn-Reverse]

When the mode signal M7 is "1", the AND condition of the AND gate 75 is satisfied by the key-on pulse KONP supplied through the OR gates 54 and 74 and the signal M7 which is "1" so that the T-flip-flop 41 is reset and the direction indication signal DIR becomes "0". Responsive to this direction indication signal which is "0", in the same manner as in the above described mode M2 (reverse), waveshape sample data is read out from the data memory 21 in the reverse direciton with the end address LPAD cosntituting the start point and the initial address constituting the end point.

When the read address has reached the initial address, the comparator 38 generates the end pulse END. This end pulse END is applied to the AND gate 73 but its output is "0". That is, if the direction indication signal DIR is "0" when the signal M7 is "1" (i.e., the address is changing in the reverse direction), the output of the AND gate 86 which receives the signal M7 and the direction indication signal DIR is "0" and the signal applied from an OR gate 87 to the AND gate 73 is "0" so that the AND condition of the AND gate 73 is not satisfied. Accordingly, in the mode M7, the flip-flop 43 is not reset by the end pulse END generated during the counting operation in the reverse direction so that the address counter 37 does not stop counting.

The outputs of the AND gate 81 and the OR gate 82 are "0" due to the signal M7 which is "1" and the direction indication signal which is "0" and the output of the AND gate 77 becomes "1" in response to the end pulse END so that the preset pulse PRP is generated through the delay flip-flop 78 and the OR gate 53.

On the other hand, the end pulse END is applied to the AND gate 71 also and, since the output of the OR gate 79 is "1" due to the signal M7 which is "1", the AND condition of the AND gate 71 is satisfied and a signal "1" is applied to the count input C of the T-flip-flop 41 through the delay flip-flop 84 so that the state of the T-flip-flop 41 is inverted from "0" to "1". The direction indication signal therefore becomes "1". The selector 42 thereby selects the initial address data (all "0") and the selector 39 selects the end address data LPAD and these address data are preset in the counter 37 and loaded in the register 40 in response to the preset pulse PRP generated in the above described manner. Thus, conversely to the preceding reading, waveshape sample data is read out from the data memory 21 in the forward direction with the initial address constituting the start point and the end address LPAD constituting the end point.

When the read address has reached the end address LPAD, the comparator 38 generates the end pulse END. The direction indication signal this time is "1" so that the AND conditions of the AND gates 81 and 86 are satisfied. The output of the AND gate 73 therefore becomes "1" and the flip-flop 43 is reset. Therefore, when the read address has reached the end address LPAD, the address counter 37 ceases its counting. In response to the output "1" of the AND gate 81, the output of the AND gate 77 becomes "0" so that the preset pulse PRP ceases to be produced.

Thus, in the case of "U turn-reverse", waveshape sample data of the data memory 21 is read out once in the reverse direction and thereafter is read out once in the forward direction. In this case, a new performance effect in which a tone in which a sampled external tone is rearranged in the timewise reverse direction is sounded once and the sampled tone which is rearranged again in the forward direciton is sounded once again can be realized.

[Mode M8: U turn-reverse-loop]

When the mode signal M8 is "1", the AND condition of the AND gate 75 is satisfied by the key-on pulse KONP and the signal M8 which is "1" supplied through the 0R gates 54 and 74 so that the T-flip-flop 41 is reset and the direction indication singal DIR becomes "0". As in the case of the mode M7 (U turn-reverse) described above, due to this direction indication signal DIR which is "0", waveshape sample data is read out from the data memory 21 in the reverse direction with the end address LPAD constituting the start point and the initial address constituting the end point.

When the read address has reached the initial address, the comparator 38 generates the end pulse END. When the signal M8 is "1", the AND condition of the AND gate 73 is not satisfied so that the flip-flop 43 is not reset by the end pulse END and the address counter 37 does not cease its counting. The AND condition of the AND gate 77 is satisfied by the end pulse END and the preset pulse PRP is generated. Since the output of the OR gate 79 is "1" due to the signal M8 which is "1", the AND condition of the AND gate 71 is satisfied by the end pulse END so that a signal "1" is applied to the count input C of the T-flip-flop 41 through the delay flip-flop 84 thereby inverting the state of the T-flip-flop 41 from "0" to "1". The direction indication signal DIR therefore becomes "1". The counting direction of the address counter 37 thereby is reversed from the preceding counting and waveshape sample data is read out from the data memory 21 in the forward direction with the initial address (all "0") constituting the start point and the end address LPAD constituting the end point.

When the read address has reached the end address LPAD, the end pulse END is generated and, in the same manner as was described above, the AND conditions of the AND gates 71 and 77 are satisfied so that the preset pulse PRP is generated and the state of the T-flip-flop 41 is inverted from "1" to "0" to turn the direction indication signal DIR to "0". The counting direction of the address counter 37 thereby is restored to the reverse direction and waveshape sample data is read out from the data memory 21 in the reverse direction with the initial address constituting the end point. Upon generation of the end pulse END, the counting direction of the address counter 37 is reversed to the forward direction.

Subsequently, in the same manner, "U turn-reverse-loop" reading is repeated each time the end pulse END is generated.

Thus, in the case of U turn-reverse-loop, "U turn-reverse" in which waveshape sample data in the data memory 21 is read out in the reverse direction and then read out in the forward direction is repeated several times. Accordingly, one can realize a new performance effect in which "U turn-reverse" according to which a tone obtained by rearranging a sampled external tone in the timewise reverse direction is sounded once and thereafter is sounded once again after rearranging the sampled tone in the timewise forward direction is repeated. By attenuating the tone volume control envelope by releasing the depressed key, this sounding can be finished.

Porcessings for increase and decrease of end address

By the above described processing of step 115 of FIG. 14, an address storing data of the final zero cross portion in the sampled original waveshape, i.e., final zero cross address (e.g., address of the block unit) is initially set as end address data stored in the end address buffer LPADB in the microcomputer section. The end address data utilized in the tone generator section 20 in the above described modes M1–M8 is the data stored in this end address buffer LPADB and, if this data is in the initially set state as described above, the end address data LPAD is the final zero cross address itself in the sampled original waveshape (i.e., data stored in the zero cross address buffer ZCRADB).

If the final zero cross address data itself in the sampled original waveshape is used as the end address data LPAD, a tone correponding to the entire original waveshape sampled from outside is sounded during the performance mode. If, however, the end address data LPAD used in the tone generator section 20 in the performance modes M1–M8 can be suitably changed without limiting it to the final zero cross address data itself in the sampled original waveshape, the performance effect can be further enhanced.

For this purpose, change in this end address data LPAD can be realized by operating the increase switch INC and the decrease switch DEC. In this embodiment, such change can be made in a mode in which sampled waveshape data is repeatedly read out and sounded, i.e., "loop", "reverse-loop", "U turn-loop" or "U turn-reverse-loop". This is because control of length of one cycle of the repeated performance by adjusting the end address is substantially effective. The invention however is not limited to this but increase and decrease in the end address data may be made in other performance modes also.

Figure 17:
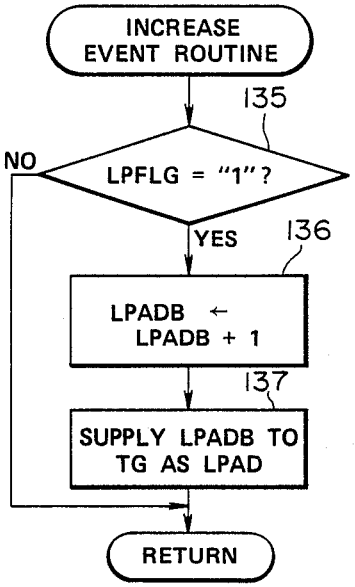

Upon turning on of the increase switch INC, increase event routine of FIG. 17 is executed. In this routine, whether the loop flag LPFLG is "1" or not is examined in step 135 and, if result is YES, the processing proceeds to step 136. If result is NO, the processing proceeds to return. This is because this control is made in the performance modes M3, M5, M6 and M8 relating to "loop". In step 136, contents of the end address buffer LPADB are increased by 1. When the contents of the buffer LPADB have reached a maximum value by this increasing operation, the maximum value is maintained. Since, as described above, data stored in the buffer LPADB is data of the block unit, this increase also is made in the block unit. In this case, the maximum value is "15". In next step 137, the contents of the end address buffer LPADB are supplied to the tone generator section 20 as the end address data LPAD.

Figure 18:
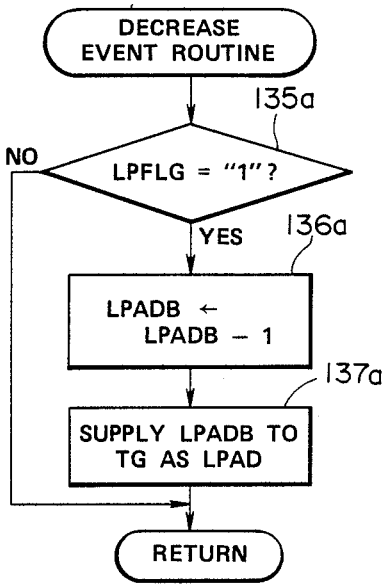

Upon turning on of the decrease switch DEC, decrease event routine of FIG. 18 is executed. Processings of steps 135*a*, 136*a* and 137*a* are substantially the same as steps 135, 136 and 137 of FIG. 17 except that in step 136, contents of the end address buffer LPADB are increased by 1 whereas in step 136*a*, contents of this buffer LPADB are decreased by 1.

By increasing and decreasing contents of the end address buffer LPADB in the foregoing manner, the value of the end address data LPAD used in the tone generator section 20 can be increased and decreased as desired.

By increasing and decreasing the value of the end address data LPAD, the address of the end point can be changed and adusted in reading in the forward direction and the address of the start point can be changed and adjusted in reading in the reverse direction so that the addresses for the basic points in repeating in the loop performance can be freely changed. Accordingly, the manner of the repeated reading can be freely changed depending upon adjustment of increase and decrease in the end address data LPAD.

For example, in a case where noise is contained in a waveshape sample data portion stored at an address before the final address of waveshape sample data, the address containing the noise can be excluded from the range of addresses for accessing the data memory 21 during the performance by properly adjusting the value of the end address data LPAD towards the address before the final end address by decreasing the value of the end address data LPAD. Thus, the waveshape sample data portion containing noise can be cut off.

On the other hand, the range of addresses for accessing the data memory 21 during the performance can be enlarged to an address at which no waveshape sample data is actually stored by properly adjusting the value of the end address data LPAD towards an address ahead of the final address of the waveshape sample data by increasing the value of the end address data LPAD. By intentionally providing a silent section of a suitable length at a junction point in the repeated reading by performing the repeated reading within the enlarged address range whereby a special performance effect in which a tone is intermittently repeated can be produced owing to existence of such silent section.

It is the contents of the end address buffer LPADB that is changed by the increase switch INC and the decrease switch DEC and the original final zero cross address in the original waveshape stored in the zero cross address buffer ZCRADB is not changed. This is used for restoring the contents of the end address buffer LPADB to the original zero cross address in the original waveshape.

Echo effect

Figure 16:
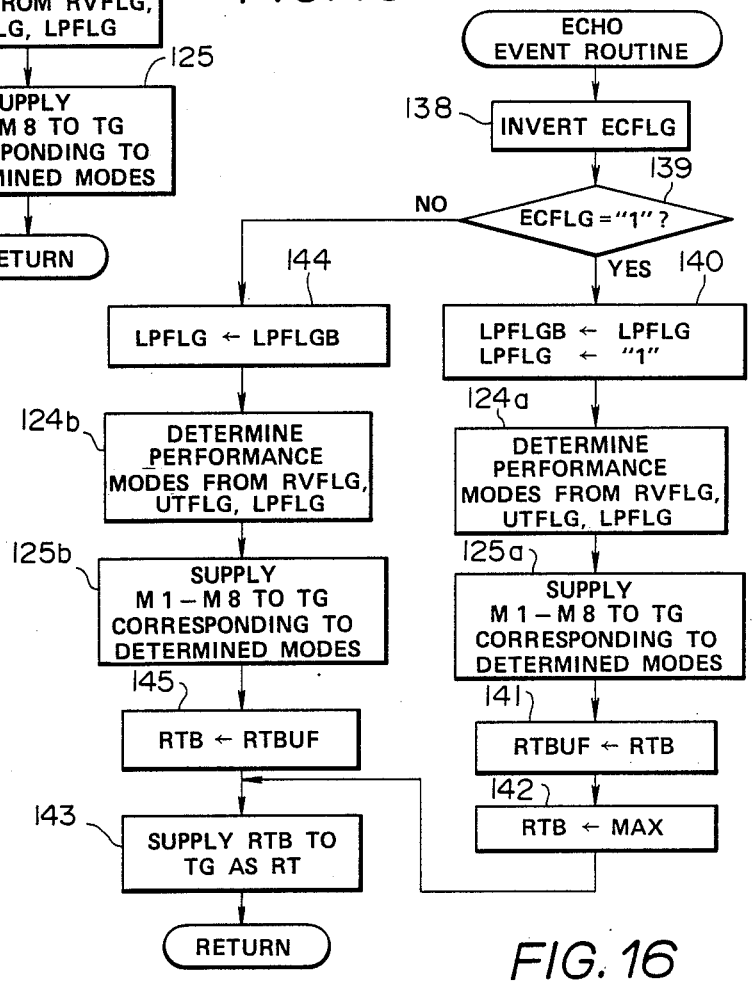

Upon turning on of the echo switch ECHO, echo event routine of FIG. 16 is executed. In step 138, the echo flag ECFLG is inverted from "0" to "1" or from "1" to "0". In step 139, whether the echo flag ECFLG is "1" or not is examined. If result is YES, the processing proceeds to step 140 in which contents of the loop flag LPFLG are stored in the loop flag buffer LPFLG and then the loop flag LPFLG is set to "1". In this manner, the performance mode is automatically set to modes relating to "loop", i.e., "loop", "reverse-loop", "U turn-loop" or "U turn-reverse-loop".

In next steps 124*a* and 125*a*, the same processings as in steps 124 and 125 of FIG. 15 are performed to determine the performance mode to one of the modes M1–M8. Since, however, the loop flag LPFLG is set to "1" in this case, the performance mode is definitely determined to one of the performance modes M3, M5, M6 and M8 relating to "loop".

Nextly, in step 141, contents of the release time buffer RTB are stored in the release time preservation buffer RTBUF and, in step 142, contents of the release time buffer RTB are set to the maximum value MAX. In step 143, contents of the release time buffer RTB are supplied to the tone generator section 20 as the release time data RT.

By the above described processings, the release time of the envelope shape data generated by the envelope generator 47 is set at the longest time with a result that the generated tone is attenuated very gradually after release of the key. Besides, since the performance mode is set at one of the modes M3, M5, M6 and M8 relating to "loop", waveshape sample data stored in the data memory 21 is repeatedly read out with the reading direction thereof being switched alternately between the forward direction and the reverse direction so that the tone corresponding thereto is repeatedly sounded with a tone volume level which gradually decreases. Since the repeatedly read out waveshape sample data is data of the sampled external tone, the data itself has an amplitude envelope from rise to fall of the tone. Accordingly, an echo effect in which a tone having an amplitude envelope from rise to fall of the tone is repeatedly sounded and its tone volume is gradually attenuated can be obtained. This echo effect is different from the conventional echo effect in that, owing to the sounding control by the performance modes M3, M5, M6 and M8 relating to "loop", the tone is sounded sometimes in the direction which is reverse to the original time sequence of sounding thereof, sometimes in the original time sequence and sometimes with a combination of both. By combining the echo effect with the increase and decrease of the end address, a comletely novel free echo effect can be realized.

When the echo flag ECFLG has become "0", contents of the loop flag buffer LPFLGB are restored to the loop flag buffer LPFLG by the processing of step 144 and the contents of the loop flag buffer LPFLG are thereby restored to the state before the echo effect was imparted In next steps 124*b* and 125*b*, the same processings as in steps 124 and 125 are executed to determine the performance mode to one of the performance modes M1–M8. In next step 145, contents of the release time preservation buffer RTBUF are restored to the release time buffer RTB and the contents of the release time buffer RTB are thereby restored to the state before the echo effect was imparted.

All cancel processing

Figure 19:
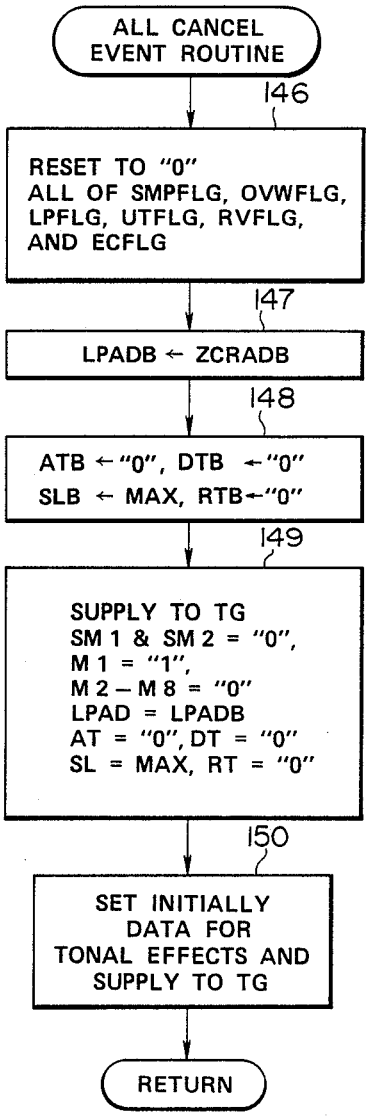

In a case where all or part of data set, selected, changed and adjusted in the operation panel section 15 in relation to the sampled waveshape sample data is to be cancelled and contents of these data are to be restored to the initial state, the all cancel switch CANSEL is operated. Thereupon, all cancel event routine of FIG. 19 is executed.

In step 146, the respective flags SMPFLG, OVWFLG, LPFLG, UTFLG, RVFLG and ECFLG are reset to "0". This operation is made for cancelling the sampling mode and the performance modes M2–M8 set and initially setting the performance mode to the mode M1 in response to operations of the respective switches SMPL, OVRWR, LOOP, UTRN, RVRS and ECHO in the operation panel 15.

In next step 147, the original zero cross address data in the original waveshape stored in the zero cross address buffer ZCRADB is stored in the end address buffer LPADB. Since the contents of the end address buffer LPADB sometimes are changed in accordance with the operations of the increase switch INC and the decrease switch DEC as described above, the processing of step 147 is made for cancelling such change and restoring the contents of the end address buffer LPADB to the original final zero cross address in the original waveshape.

In step 148, contents of the attack time buffer ATB, decay time buffer DTB, sustain level buffer SLB and release time buffer RTB are initially set to contents determining the above described direct keying type envelope shape. This processing is made for cancelling contents of the buffers ATB, DTB, STB and RTB which have been changed in accordance with operation of the envelope control operator group 17 and initially setting the contents of these buffers to those determining the direct keying type envelope shape.

In step 149, data to be supplied to the tone generator section 20 is initially set in the following manner and supplied to the tone generator section 20: The sampling mode signals SM1 and SM2 are turned to "0". The performance mode signal M1 is turned to "1" and the rest of the performance mode signals M2–M8 are turned to "0". The end address data LPAD is set to the final zero cross address data stored in the end address buffer LPADB. Contents of the buffers ATB, DTB, SLB and RTB are respectively set as attack time data AT, decay time data DT, sustain level data SL and release time data RT. In next step 150, data for various tonal effects are initially set to predetermined contents.

In the foregoing manner, by the operation of the all cancel switch CANSEL, all or part of data set, selected, changed and adjusted in the operation panel section 15 in relation to the waveshape sample data are cancelled and contents of such data are restored to the initially sampled state. In other words, contents of various data edited in relation to the sampled waveshape sample data are cancelled and restored to the initial state before the editing. By cancelling the contents of edition and restoring the contents to the initial state before editing, editing of data can be made freely without apprehension of commiting mistake so that the editing function in relation to the sampled waveshape data can be improved.

Modifications

In the above described embodiments, waveshape sample data stored in the data memory is expressed in PCM (pulse code modulation). The mode of expression of data is not limited to this but other suitable data compression system such as difference PCM, delta modulation (DM) and adaptive delta modulation (ADM) can be employed to express data. Alternatively, the sampled waveshape sample data may be sugjected to data correction processing (e.g., a processing for regularizing the data so that its amplitude level becomes substantially constant throughout the entire data) before being written into the data memory. In this case, the data correction processing (such as the level regularizing processing) may be imparted to an analog tone signal picked up through a microphone.

The processings of FIGS. 8–19 executed by the software processings in the microcomputer section may be carried out by an exclusive hardware circuit. Conversely, in FIG. 6, the read and write control circuits for the data memory in the tone generator section are constructed of exclusive hardware circuits but these circuits may be executed by a software processing in the microcomputer section. Further, in FIG. 6, a common circuit (e.g., address counter) is partly used for the reading and writing controls but these controls may be performed by separate circuits.

The above described embodiments are of a single tone sounding system but the invention is applicable also to a multitone sounding system. In that case, the known key assigning processing technique for plural channels may be employed.

In the above described embodiments, the tone signal generation device according to the invention is applied to an electronic musical instrument having a keyboard. The scope of the invention however is not limited to this but the device according to the invention may be applied to other devices including other types of electric or electronic musical instruments, a moduled keyboard, input devices, sound system, effect device and a tone source device module which can be selectively connected to a general use computer in use.

Although not particularly illustrated in the above described embodiments, display devices made of, e.g., LEDs which display the currently selected performance mode, contents of the currently set end address data LPAD, contents of the various envelope determining data and contents of other various data may be provided as required.

In the above described embodiments, eight performance modes M1–M8 are determined in response to the operations of the three switches RVRS, UTRN and LOOP. Alternatively, switches for individually selecting the respective modes M1–M8 may be separately provided.

In the tone generator section of FIG. 6, a tone sampled from outside only is used as a tone source. The tone source however is not limited to this but other suitable tone source may be provided and a desired tone color may be selected from among tone colors which are already prepared and a tone color of a sampled external tone.

In the above described embodiments, the key-on pulse OKONP used as the trigger for sounding a sampled tone automatically immediately after an external tone has been sampled is generated by a software processing (i.e., step 118 in FIG. 14). The generation of the key-on pulse OKONP however may be made by an exclusive hardware circuit in the tone generator section. For this purpose, for example, when the sampling signal SMPEND has been produced, i.e., the end pulse END has been produced, counting of the address counter 37 is not stopped but upcounting from the initial address is continued by allowing the counter to overflow and the sampling end signal SMPEND is applied to the envelope generator 47 as the key-on pulse OKONP for the immediate and automatic sounding while the sampling mode signals SM1 and SM2 are turned to "0" and the mode signal M1 is turned to "1".

In the above described embodiments, the rate of the reading of the data memory in the immediate and automatic sounding after sampling of the external tone is the same as the rate of the writing. These rates, however, may be differed from each other.

The manner of zero cross is not limited to the one described with respect to the above described embodiments but any suitable manner may be employed. For example, instead of using the zero judgement range having a certain width as in the above described embodiments, zero cross may be detected by detecting actual change in the level of waveshape sample data from positive level to negative one. Alternatively, zero cross may be detected in an analog tone signal picked up by a microphone.

In the above described embodiments, the address corresponding to zero cross is stored in unit of block. Alternatively, the address may be stored in unit of address.

Similarly, in storing the end address data (LPAD) corresponding to final zero cross address, the data is not limited to data in unit of block but it may be data in unit of address. In the latter case, the amount of increase of decrease in adjusting the end address data may be finely adjusted in unit of address. The reference address to be adjusted is not limitedt to an end address as in the above described embodiments but it may be an initial address or both end address and initial address.

Actual final zero cross address may be stored for each block and, when the end address data is increased or decreased in unit of block, actual final zero cross address in a block which has been determined as the end address may be used as end address (i.e., 12-bit end address in unit of address).

In the above described embodiments, increase or decrease of the end address data can be made when the loop flag has risen, i.e., the tone corresponding to the sampled external tone is repeatedly sounded. An arrangement may however be made so that increase or decrease of the end address (reference address data) is made in other cases.

In the above described embodiments, in the all cancel processing, all data set and controlled in the operation panel section are cancelled and restored to a predetermined initial state. Alternatively, data closely relating to the sampled external tone only may be cancelled and restored to a predetermined initial state. In this case, various tonal effect data, for example, need not be cancelled.

As described in detail above, according to the invention, actual final address of external tone waveshape sample data written in the meory means is detected simultaneously and in parallel with writing thereof. Accordingly, performances based on versatile reading manners according to which waveshape sample data in the memory means is read out in a forward or reverse direction by using this final address as an end point or a start point can be made immediately after writing whereby performance efficiency of the tone signal generation device of the sampling system can be greately improved.

Further, according to the invention, the reference address which constitutes a start point or an end point in reading out waveshape sample data stored in the memory means in a forward or reverse direction can be freely adjusted. The range of address for reading from the memory can thereby be changed and the range of a tone to be sounded can be freely changed so that performance efficiency of the tone signal generation device of the sampling type can be improved.

If, for example, an original reference address is set at a final address of waveshape sample data and noise is contained in waveshape sample data stored at an address before this final address, the address at which the noise occurs can be excluded from the range of addresses to be accessed in the memory means by properly adjusting the reference address so as to shift it towards an address before the address at which the noise occurs whereby the portion of waveshape sample data containing noise can be cut off. Again, if an original reference address is set at a final address of waveshape sample data, the range of address to be accessed in the memory means can be expanded to an address at which waveshape sample data is actually not stored by properly adjusting the reference address so as to shift it towards an address ahead of this final address. By performing repeated reading whithin this expanded address range, a silent section of a suitable time length can be intentionally created at a junction point in the repeated reading so that a special performance effect in which the tone is intermittently sounded can be produced. Besides, the manner of the repeated reading can be freely changed by adjusting the reference address suitably.

Furthermore, according to the invention, by sampling a tone singal applied from outside and storing it in the memory means and reading the stored data immediately and automatically after the writing, the sampled tone can be sounded immediately and automatically. Accordingly, a tone corresponding to the sampled tone signal can be confirmed instantly without a special performance operation such as key depression whereby performance efficiency of the tone signal generation device of the sampling system can be greatly improved.

What is claimed is:

1. A tone signal generation device comprising:

tone sampling means for sampling a tone signal;

memory means, capable of both reading and writing, for storing waveshape sample data;

write control means for writing waveshape sample data of the tone signal sampled by said tone sampling means into said memory means;

zero cross detection means for detecting, simultaneously with the writing of waveshape sample data of the tone signal sampled by said tone sampling means into said memory means, zero crossings representative of zero crossings of the tone signal;

final address detection means for storing a write address of waveshape sample data in said memory means each time a zero crossing is detected by said zero cross detection means and detecting a final address stored when writing has been completed as a final address of said waveshape sample data;

read control means for reading out said waveshape sample data in said memory means, wherein said read control means is capable of reading out said waveshape sample data in a forward direction and in a reverse direction, said read control means using the final address detected by said final address detection means as an end point or a start point for reading out said waveshape sample data; and means for generating a tone signal corresponding to said waveshape sample data read out from said memory means.

2. A tone signal generation device as defined in claim 1 wherein said final address detection means stores, in unit of a block consisting of plural addresses, a block corresponding to the address for which zero cross has been detected and detects a final address in a final block stored when writing has been completed as said final address of said waveshape sample data.

3. A tone signal generation device as defined in claim 1 wherein said zero cross detection means detects whether level of said tone signal or said waveshape sample data has entered a predetermined zero judgement range or not.

4. A tone signal generation device as set out in claim 1, wherein said zero cross detection means detects zero crossings of the tone signal.

5. A tone signal generation device as set out in claim 1, wherein said zero cross detection means detects zero crossings of the waveshape sample data.

6. A tone signal generation device comprising:
sampling means for sampling a tone signal;
memory means, capable of both reading and writing, for storing waveshape sample data;
write control means for writing waveshape sample data of the tone signal sampled by said tone sampling means into said memory means;
read control means for reading out said waveshape sample data in said memory means, wherein said read control means is capable of reading out said waveshape sample data in a forward direction and in a reverse direction, said read control means using a predetermined reference address as a start point or an end point for reading out said waveshape sample data;
reference address adjusting means for increasing or decreasing the reference address; and
means for generating a tone signal corresponding to said waveshape sample data read out from said memory means.

7. A tone signal generation device as defined in claim 6 wherein said read control means can select whether said waveshape sample data should be repeatedly read out or not and said reference address adjusting means can increase or decrease the reference address when the repeated reading of the waveshape sample data has been selected by said read control means.

8. A tone signal generation device as defined in claim 6 wherein said write control means writes said waveshape sample data from a predetermined head address and said reference address is a final address of said waveshape sample data written in said memory means.

9. A tone signal generation device as defined in claim 6 wherein said reference address is a head address or final address of said waveshape sample data written in said memory means and said reference address adjusting means changes at least one of the head address and the final address.

10. A tone signal generation device as defined in claim 6 wherein said reference address adjusting means increases or decreases the reference address in unit of a block consisting of plural addresses.

11. A tone signal generation device comprising:
tone sampling means for sampling a tone signal;
memory means, capable of both reading and writing, for storing waveshape sample data;
write control means for writing waveshape sample data of the tone signal sampled by said tone sampling means into said memory means;
read control means for reading out said waveshape sample data written in said memory means, in response to completion of writing of said waveshape sample data in said memory means, to reproduce the sampled tone signal, and
means for providing a tone signal corresponding to said waveshape sample data read out from said memory means upon said completion of writing.

12. A tone signal generation device as defined in claim 11 wherein said read control means comprises write completion detection means for detecting completion of writing of said waveshape sample data, means for generating a readout start signal in response to the detection of completion of writing and means for reading out said waveshape sample data written in said memory means in response to the readout start signal.

13. A tone signal generation device as defined in claim 12 wherein said write completion detection means detects completion of writing by detecting that the write address in said memory means has reached a final address of a memory area of waveshape sample data for one tone in said memory means.

14. A tone signal generation device as defined in claim 11 wherein said read control means performs reading at the same rate as a rate of writing the waveshape sample data by said write control means.

15. A tone signal generation device as defined in claim 11 further comprising means for controlling tone signal generation by controlling an amplitude with an envelope of a substantially uniform level from start of sounding of the tone to the end of sounding of the tone.

16. A tone signal generation device as defined in claim 11 further comprising sounding control means, for controlling sounding of the tone signal, comprising means for detecting an address at which a final portion of the waveshape sample data is stored in said memory means and means for finishing sounding when read address in said memory means has reached said address at which the final portion of waveshape sample data is stored.

17. A tone signal generation device comprising:
tone sampling means for sampling a tone signal;
memory means, capable of both reading and writing, for storing waveshape sample data;
write control means for writing waveshape sample data of the tone signal sampled by said tone sampling means into said memory means;
read control means for reading out waveshape sample data stored in said memory means in a reverse direction and thereafter continuously reading out the same waveshape sample data in a forward direction; and
means for generating a tone signal corresponding to said waveshape sample data read out from said memory means by said read control means.

18. A tone signal generation device as defined in claim 17 wherein said read control means performs control in such a manner that the reading of said waveshape sample data in the reverse direction and the subseqent reading in the forward direction are made repeatedly.

19. A tone signal generation device as defined in claim 17 wherein said read control means comprises U turn reading selection means for selecting reading of the waveshape sample data stored in said memory means in a forward direction and subsequently in the reverse direction and reverse reading selection means for selecting reading of the waveshape sample data stored in said memory means and, when the U turn reading and the reverse reading have been selected simultaneously by said U turn reading selection means and said reverse reading selection means, the read control means performs control in such a manner that the waveshape sample data is read out in the reverse direction and then continuously the waveshape sample data is read out in the forward direction.

20. A tone signal generation device comprising:
tone sampling means for sampling a tone signal;
memory means capable of both reading and writing for storing waveshape sample data;
write control means for writing waveshape sample data of the tone signal sampled by said tone sampling means into said memory means;
selecting means for selecting a predetermined performance mode;
read control means for reading out said waveshape sample data stored in said memory means repeatedly when said predetermined performance mode has been selected by said selecting means;
wherein waveshape sample data stored in the memory means is imparted with an envelope covering from a rise portion to a fall portion of a single repeating period; and
envelope imparting means for imparting a gradually attenuating tone volume envelope to a tone signal generated in accordance with waveshape sample data repeatedly read out over plural repeating periods from said memory means by said read means.

21. A tone signal generation device as defined in claim 20 wherein attenuation time of the tone volume envelope imparted by said envelope imparting means is sufficiently longer than one repeating period of said waveshape sample data.

22. A tone signal generation device comprising:
tone sampling means for sampling a tone signal and providing waveshape sample data corresponding to the sampled tone signal;
memory means, capable of both reading and writing, for storing waveshape sample data;
write control means for writing the waveshape sample data of the tone signal sampled by said tone sampling means into said memory means;
final address detection means for detecting a final address of the waveshape sample data written in said memory means;
overwrite control means associated with said write control means for adding waveshape sample data which has newly been sampled by said tone sampling means to waveshape sample data stored in said memory means and causing waveshape sample data which is a result of the addition to be written into said memory means;
final address detection control means associated with said final address detection means and said overwrite control means for performing control in such a manner that, when the adding by said overwrite control means is performed, either a final address of waveshape sample data which is already stored in said memory means or a final address of waveshape sample data of a tone signal which has newly been sampled by said tone sampling means having a larger data size is detected as a final address of waveshape sample data which is a result of addition;
read control means for reading out waveshape sample data stored in said memory means, wherein said read control means is capable of reading out said waveshape sample data in a forward direction and in a reverse direction, said read control means using said final address detected by said final address detection means as an end point or a start point; and
means for generating a tone signal corresponding to the waveshape sample data read out from said memory means.

23. A tone signal generation device comprising:
tone sampling means for sampling a tone signal and providing waveshape sample data corresponding to the sampled tone signal;
memory means, capable of both reading and writing, for storing waveshape sample data;
write control means for writing the waveshape sample data of the tone signal sampled by said tone sampling means into said memory means;
read control means for reading the waveshape sample data stored in said memory means, and generating a tone signal corresponding to the read out waveshape sample data;
operation means for selecting or setting the reading operation of said read control means and for setting or adjusting data associated with the reading control by said read control means; and
cancel means for restoring data associated with the reading operation selected or set by said operation means to a predetermined initial state.

24. A tone signal generation device comprising:
tone sampling mean for sampling a tone signal;
memory means, capable of both reading and writing, for storing waveshape sample data;
write control means for writing waveshape sample data of the tone signal sampled by said tone sampling means into said memory means;
zero crossing detection means for detecting zero crossings representative of zero crossings of the tone signal during writing of the waveshape sample data into said memory means;
final address detection means for storing a write address of waveshape sample data in said memory means each time a zero crossing is detected by said zero crossing detection means and detecting a final address stored when writing has been completed as a final address of said waveshape sample data;
read control means for reading out said waveshape sample data in said memory means; and
mean for generating a tone signal corresponding to said waveshape sample data read out from said memory means.

* * * * *

UNITED STATES PATENT AND TRADEMARK OFFICE

CERTIFICATE OF CORRECTION

PATENT NO. : 4,947,723

DATED : August 14, 1990

INVENTOR(S) : Susumu Kawashima, et al.

It is certified that error appears in the above-identified patent and that said Letters Patent is hereby corrected as shown below:

Title Page

Item [21] Appl. No.: delete "141,422" and insert therfor --141,122--.

Signed and Sealed this

Seventh Day of January, 1992

*Attest:*

HARRY F. MANBECK, JR.

*Attesting Officer*

*Commissioner of Patents and Trademarks*